US008113506B2

(12) United States Patent
Kaseda

(10) Patent No.: US 8,113,506 B2
(45) Date of Patent: Feb. 14, 2012

(54) SHEET SUPPLY APPARATUS AND IMAGE FORMING APPARATUS

(75) Inventor: Shinya Kaseda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/500,068

(22) Filed: Jul. 9, 2009

(65) Prior Publication Data

US 2010/0052247 A1 Mar. 4, 2010

(30) Foreign Application Priority Data

Aug. 26, 2008 (JP) ..... 2008-217028

(51) Int. Cl.
*B65H 1/00* (2006.01)

(52) U.S. Cl. ..... 271/171; 271/145; 271/162; 271/164

(58) Field of Classification Search ..... 271/171, 271/145, 162, 164
See application file for complete search history.

(56) References Cited

U.S. PATENT DOCUMENTS

| | | | | |
|---|---|---|---|---|
| 5,172,902 | A * | 12/1992 | Hashimoto et al. | 271/164 |
| 5,901,952 | A * | 5/1999 | Hourtash | 271/171 |
| 5,927,707 | A * | 7/1999 | Miura | 271/171 |
| 5,931,456 | A * | 8/1999 | Laidlaw | 271/171 |
| 6,267,371 | B1 * | 7/2001 | Jessop | 271/171 |
| 7,648,135 | B2 * | 1/2010 | Matsushima | 271/171 |
| 7,694,958 | B2 * | 4/2010 | Nakamura | 271/171 |
| 2003/0151188 | A1 * | 8/2003 | Imahara | 271/171 |
| 2008/0001346 | A1 * | 1/2008 | Meetze et al. | 271/171 |
| 2008/0079214 | A1 * | 4/2008 | Kawarago | 271/18 |
| 2009/0236796 | A1 * | 9/2009 | Chino | 271/171 |
| 2009/0295073 | A1 * | 12/2009 | Furusawa | 271/171 |
| 2010/0001460 | A1 * | 1/2010 | Kawarago | 271/162 |

FOREIGN PATENT DOCUMENTS

| | | | |
|---|---|---|---|
| JP | 04323141 | A * | 11/1992 |
| JP | 06032468 | A * | 2/1994 |
| JP | 07-206167 | | 8/1995 |
| JP | 08-239128 | | 9/1996 |
| JP | 2003-276868 | | 10/2003 |
| JP | 2007-191277 | | 8/2007 |
| JP | 2007-223686 | | 9/2007 |
| JP | 2008-063143 | | 3/2008 |

* cited by examiner

*Primary Examiner* — Kaitlin Joerger
*Assistant Examiner* — Prasad Gokhale
(74) *Attorney, Agent, or Firm* — Kubotera & Associates, LLC

(57) ABSTRACT

A sheet supply apparatus is provided with a print medium storage device for storing a print medium. The print medium storage device includes a guide member for guiding the print medium thus stored; an engaging portion for engaging the guide member at a specific position; an engaged portion for engaging the engaging portion; an operation portion disposed to be movable for separating the engaging portion from the engaged portion; and an abutting portion for abutting against the operation portion to move the operation portion when the print medium storage device is situated at a first position, and for separating from the operation portion when the print medium storage device is situated at a second position.

16 Claims, 23 Drawing Sheets

SHEET SUPPLY APPARATUS AND IMAGE FORMING APPARATUS

BACKGROUND OF THE INVENTION AND RELATED ART STATEMENT

The present invention relates to a sheet supply apparatus and an image forming apparatus.

A conventional sheet supply tray is provided in an image forming apparatus, and the conventional sheet supply tray includes a side guide member movably attached to a bottom plate thereof for guiding both of left and right edges or one edge of a print medium in a transportation direction according to a size of the print medium. The side guide member is arranged to be movable and fixed at a position corresponding to a width of a standard print medium such as the A4-size sheet and the A5-size sheet (refer to Patent Reference).

Patent Reference: Japanese Patent Publication No. 2003-276868

SUMMARY OF THE INVENTION

According to a first aspect of the present invention, a sheet supply apparatus is provided with a print medium storage device for storing a print medium. The print medium storage device includes a guide member for guiding the print medium thus stored; an engaging portion for engaging the guide member at a specific position; an engaged portion for engaging the engaging portion; an operation portion disposed to be movable for separating the engaging portion from the engaged portion; and an abutting portion for abutting against the operation portion to move the operation portion when the print medium storage device is situated at a first position, and for separating from the operation portion when the print medium storage device is situated at a second position.

According to a second aspect of the present invention, an image forming apparatus is provided with a sheet supply apparatus, and the sheet supply apparatus is provided with a print medium storage device for storing a print medium. The print medium storage device includes a guide member for guiding the print medium thus stored; an engaging portion for engaging the guide member at a specific position; an engaged portion for engaging the engaging portion; an operation portion disposed to be movable for separating the engaging portion from the engaged portion; and an abutting portion for abutting against the operation portion to move the operation portion when the print medium storage device is situated at a first position, and for separating from the operation portion when the print medium storage device is situated at a second position.

With the sheet supply apparatus of the present invention, it is possible to stably supply the print medium without paper jam even when the print medium thus stored has a variance in a width thereof. With the image forming apparatus of the present invention, it is possible to stably form an image without paper jam even when the print medium thus stored has a variance in a width thereof.

BRIEF DESCRIPTION OF THE DRAWINGS

FIGS. 13(*c*) and 13(*d*) are schematic enlarged views showing the second engaging claw in a third state that the second engaging claw engages the second engaging groove group and a fourth state that the second engaging claw is disengaged from the second engaging groove group taken along a line 13(*c*)-13(*c*) in FIG. 8 according to the first embodiment of the present invention;

DETAILED DESCRIPTION OF THE PREFERRED EMBODIMENTS

Hereunder, embodiments of the present invention will be explained with reference to the accompanying drawings. Note that the present invention is not limited to the embodiments, and the embodiments may be modified within scope of the present invention.

First Embodiment

A first embodiment of the present invention will be explained. First, a printer 400 as an image forming apparatus will be explained. The printer 400 is provided with a sheet supply tray 101 as a print medium storage device. The sheet supply tray 101 and an expansion sheet supply apparatus 103 will be explained. The sheet supply tray 101 is detachably attached to the expansion sheet supply apparatus 103.

Figure 1:
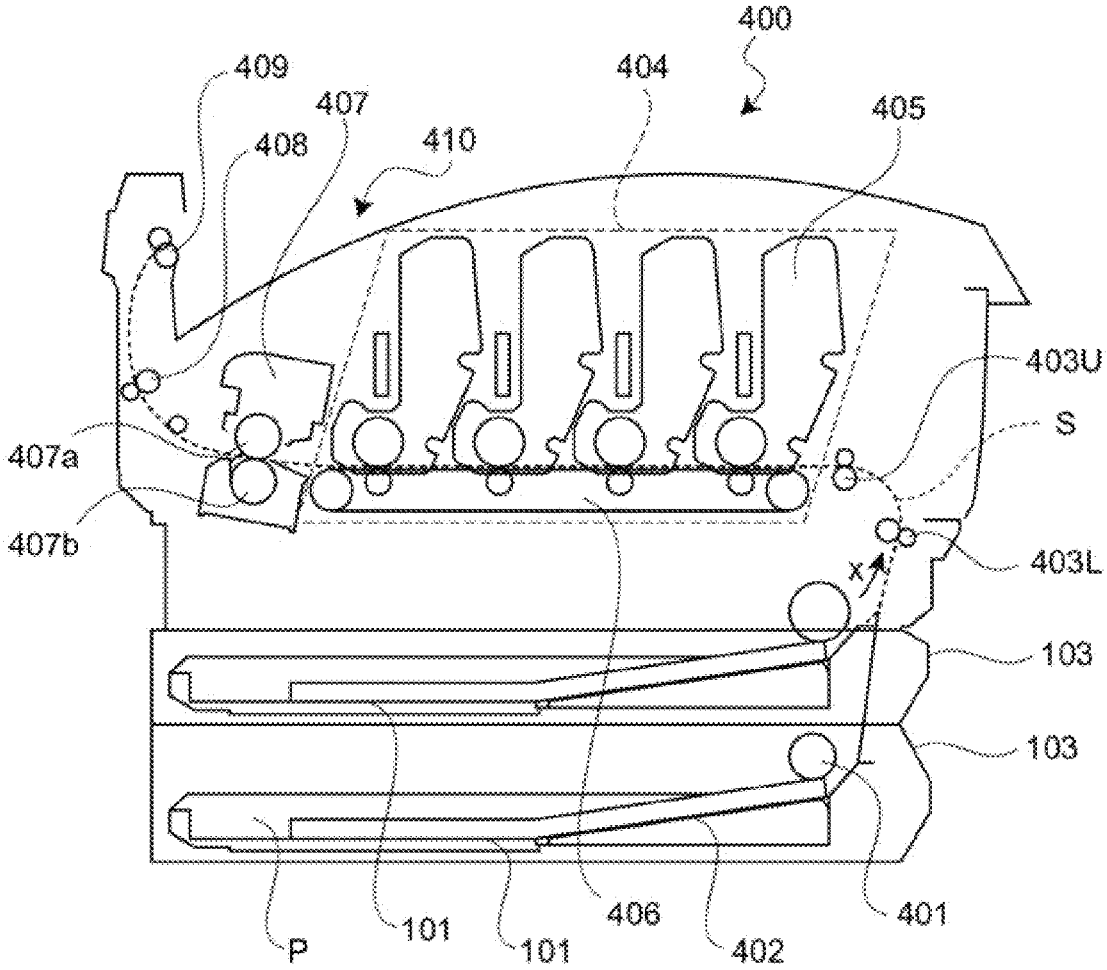
FIG. 1 is a schematic sectional view showing a configuration of a printer according to a first embodiment of the present invention.

FIG. 1 is a schematic sectional view showing a configuration of the printer 400 according to the first embodiment of the present invention. The printer 400 may be a color printer of an electro-photography type, and is capable of printing an image on a print medium according to print data input thereto.

In the embodiment, the printer 400 includes the sheet supply tray 101 as the print medium storage device for placing a sheet P as the print medium; the expansion sheet supply apparatus 103 to which the sheet supply tray 101 is detachably attached; a sheet supply roller 401 for transporting the sheet P in an arrow direction X; a hopper 402 for pressing the sheet P against the sheet supply roller 401; transport rollers 403L and 403U for correcting skew of the sheet P and transporting the sheet P to an image forming unit 404; the image forming unit 404 for forming a developer image according to the print data thus input; a fixing unit 407 for heating and pressing the developer image on the sheet P formed with the image forming unit 404 to fix the developer image; a discharge roller 408 for discharging the sheet P to a medium discharge portion 409 after the sheet P passes through the fixing unit 407; the medium discharge portion 409 for discharging the sheet P to outside the printer 400; a medium stacker 410 for placing the sheet P discharged from the medium discharge portion 409; and a sheet transportation path S formed in an S character shape relative to a lower frame of the printer 400.

In the embodiment, the sheet supply tray 101 stores the sheet P therein in a stacked state, and is detachably attached to a lower portion of the printer 400. The sheet supply roller 401 is disposed at an upper portion of the sheet supply tray 101 for separating and picking up the sheet P one by one. Further, the sheet supply tray 101 is detachably attached to the expansion sheet supply apparatus 103 functioning as an adapter of the sheet supply tray 101 with respect to the printer 400. Note that the sheet supply tray 101 and the expansion sheet supply apparatus 103 will be explained in more detail later.

In the embodiment, a drive source (not shown) drives the sheet supply roller 401 to rotate, so that the sheet supply roller 401 transports the sheet P picked up from the sheet supply tray 101 to the transport rollers 403L and 403U. The hopper 402 is provided with an urging member (not shown) for pressing the sheet P against the sheet supply roller 401.

In the embodiment, the transport rollers 403L and 403U are provided for correcting skew of the sheet P. Further, a drive source (not shown) drives the transport rollers 403L and 403U to rotate, so that the transport rollers 403L and 403U transport the sheet P to the image forming unit 404.

In the embodiment, the image forming unit 404 includes developing portions 405 for developing with developer corresponding to four colors, i.e., black, yellow, magenta, and cyan, so that the developer image is formed according to the print data thus input. The developing portions 405 are detachably attached to the printer 400 along the sheet transportation path S. After the developing portions 405 form the developer image, transfer units 406 transfer the developer image to the sheet P.

In the embodiment, after the developer image is transferred to the sheet P, the fixing unit 407 applies heat and pressure to the sheet P when the sheet P passes through a nip portion between a heating roller 407*a* and a fixing belt 407*b*, so that the developer image is fixed to the sheet P.

In the embodiment, after the sheet P passes through the fixing unit 407, a drive source (not shown) drives the discharge roller 408 to rotate, so that the discharge roller 408 transports the sheet P to the medium discharge portion 409. The medium discharge portion 409 includes a plurality of rollers and a guide member, and discharges the sheet P to the medium stacker 410 after the sheet P passes through the fixing unit 407. The medium stacker 410 is formed of a housing outer surface of the printer 400 for placing the sheet P discharged from the medium discharge portion 409.

In addition to the components described above, the printer 400 further includes a print control unit having a microprocessor, an ROM (Read Only Memory), an RAM (Random Access Memory), an input/output port, a timer, and the likes; an interface control unit for receiving the print data and a control command and controlling an entire sequence of the printer 400 to perform a printing operation; a display unit having a display unit such as an LCD (Liquid Crystal Display) for displaying a state of the printer 400; an operation unit having an input device such as a touch panel for inputting an instruction from an operator; various sensors such as a temperature/humidity sensor, a density sensor, and the likes for monitoring an operation state of the printer 400; a head drive control unit for controlling drive of a print head portion (not shown); a temperature control unit for controlling a temperature of the fixing unit 407; a sheet transport motor control unit for controlling a drive motor as a drive source for rotating the various rollers to transport the sheet P; a drive control unit for controlling a drive motor to rotate the rollers disposed in the developing portions 405; and various power sources for applying voltages to the rollers.

With the configuration described above, the printer 400 is capable of forming an image on the sheet P according to the print data input thereto.

Figure 2:
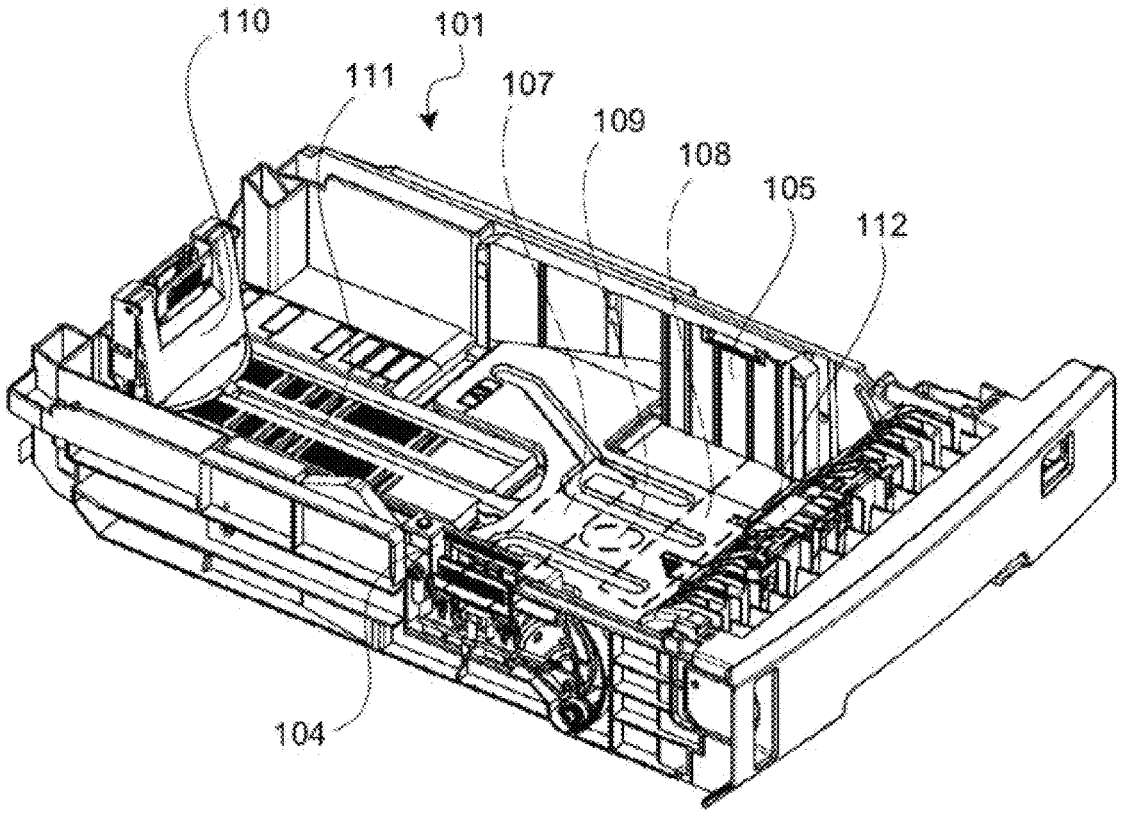
FIG. 2 is a perspective view showing a sheet supply tray according to the first embodiment of the present invention.
Figure 3:
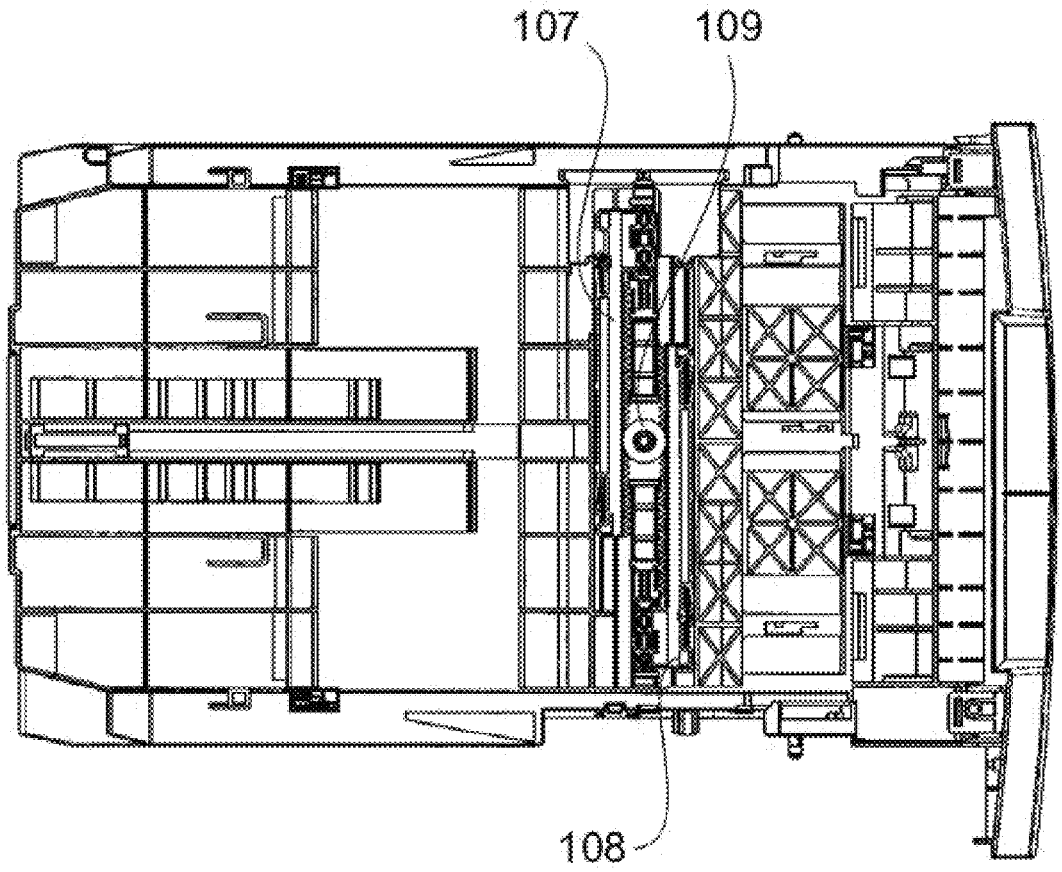
FIG. 3 is a bottom side view showing the sheet supply tray according to the first embodiment of the present invention.
Figure 4:
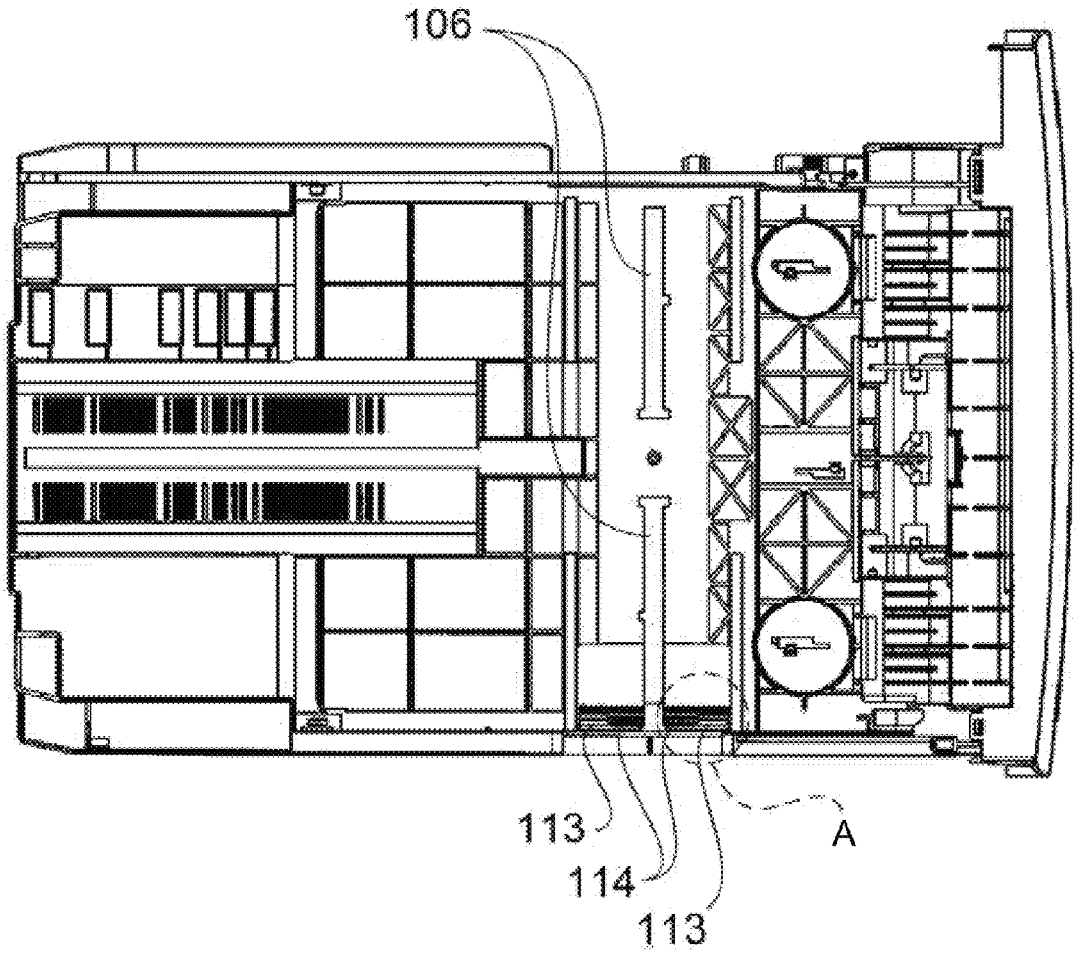
FIG. 4 is a plan view showing the sheet supply tray according to the first embodiment of the present invention.

Next, the sheet supply tray 101 and the expansion sheet supply apparatus 103 to which the sheet supply tray 101 is detachably attached will be explained. FIG. 2 is a perspective view showing the sheet supply tray 101 according to the first embodiment of the present invention. FIG. 3 is a bottom side view showing the sheet supply tray 101 according to the first embodiment of the present invention. FIG. 4 is a plan view showing the sheet supply tray 101 according to the first embodiment of the present invention.

As shown in FIGS. 2 to 4, the sheet supply tray 101 includes an L-side (left side) sheet guide 104; an R-side (right side) sheet guide 105; side guide slide grooves 106; an L-side rack 107; an R-side rack 108; a pinion gear 109; a tail guide 110; and a tail guide slide groove 111.

As shown in FIG. 2, the sheet supply tray 101 has a box shape with an upper opening portion, and is configured to be detachable relative to the expansion sheet supply apparatus 103 (described later). The L-side sheet guide 104 and the R-side sheet guide 105 are disposed inside the sheet supply tray 101 as guide members formed of a plastic for aligning the sheet P at a position in a width direction thereof perpendicular to a transportation direction of the sheet P. The L-side sheet guide 104 and the R-side sheet guide 105 are fitted in the side guide slide grooves 106 formed in a backside surface of the sheet supply tray 101 and extending in a direction perpendicular to the transportation direction of the sheet P.

In the embodiment, the L-side rack 107 is attached to the L-side sheet guide 104, and the R-side rack 108 is attached to the R-side sheet guide 105. The pinion gear 109 connects the L-side rack 107 and the R-side rack 108. The tail guide 110 is fitted in the tail guide slide groove 111 formed at a rear end portion of the sheet supply tray 101 in the transportation direction of the sheet P for aligning a trailing edge of the sheet P. A sheet separation member 112 having a roller shape formed of a rubber is disposed at a position facing the sheet supply roller 401.

As shown in FIG. 4, engaging groove groups are formed in a bottom surface portion of the sheet supply tray 101 as engaged portions for engaging the L-side sheet guide 104. The engaging groove groups includes two types of engaging groups two of each type disposed in two rows, thereby totaling four rows. More specifically, second engaging groove groups 114 are disposed on both sides of the side guide slide groove 106 in a direction perpendicular to a direction that the side guide slide groove 106 extends, and first engaging groups 113 are disposed outside the second engaging groove groups 114.

Figure 5:
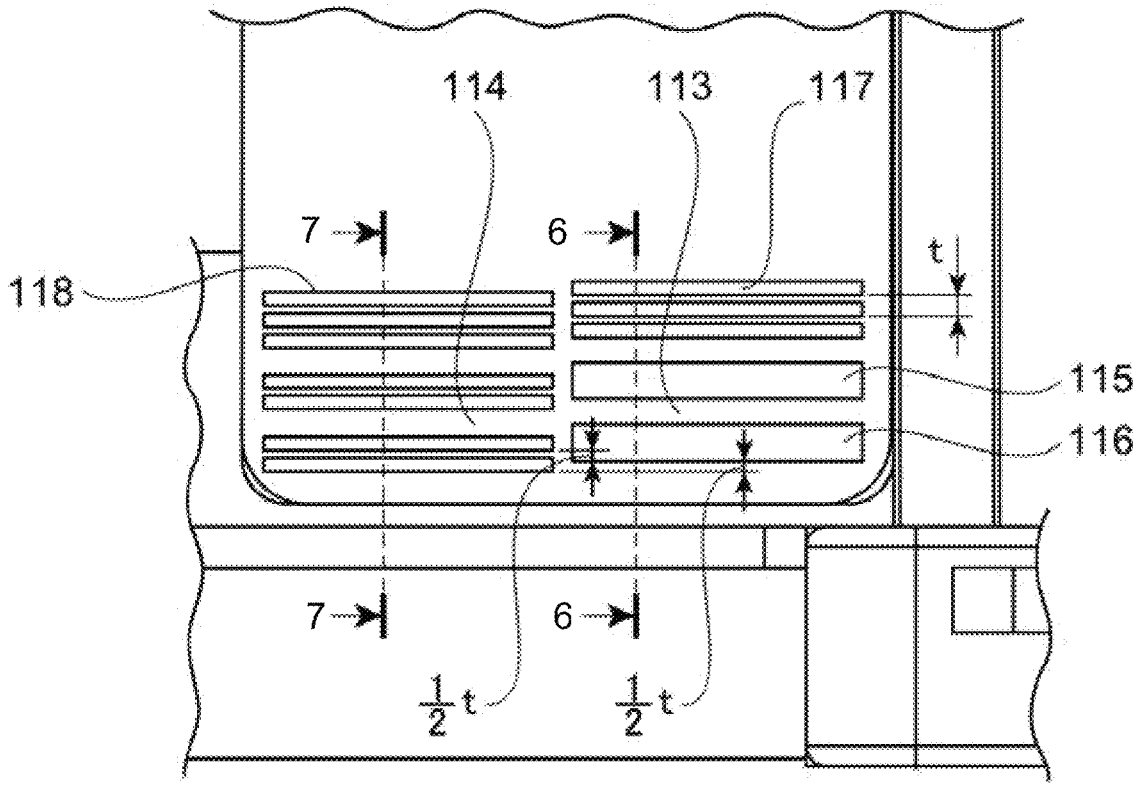
FIG. 5 is a schematic partially enlarged view of a portion A shown in FIG. 4 showing a first engaging groove group and a second engaging groove group of the sheet supply tray according to the first embodiment of the present invention.

FIG. 5 is a schematic partially enlarged view of a portion A shown in FIG. 4 showing the first engaging groove group 114 and the second engaging groove group 113 of the sheet supply tray 101 according to the first embodiment of the present invention.

As shown in FIG. 5, the first engaging group 113 includes an A4-size sheet groove 115 for engaging the L-side sheet guide 104 at a position such that the L-side sheet guide 104 and the R-side sheet guide 105 contact with side edges of a sheet having the A4-size. Similarly, the first engaging group 113 includes a letter size sheet groove 116 for engaging the L-side sheet guide 104 at a position such that the L-side sheet guide 104 and the R-side sheet guide 105 contact with side edges of a sheet having a letter size. Further, the first engaging group 113 includes first irregular size grooves 117 with a pitch t in between at positions corresponding to irregular sizes of the sheet P other than the standard size such as the A4-size and the letter size.

In the embodiment, the pitch t is set to 1 mm. The second engaging group 114 includes second irregular size grooves 118 situated away from the first engaging group 113 by a half of the pitch t (½t=0.5 mm) in a width direction of the sheet P.

In the embodiment, the second engaging groove group 114 is situated away from the first engaging group 113 by a half of the smallest pitch t of the first engaging group 113. When a plurality of engaging claws and a plurality of engaging groove groups are provided in an n number of stages, i.e., an n-stage system, an n-th engaging groove group may be situated away from the first engaging groups 113 by a 1/n of the smallest pitch of the first engaging groups 113, thereby making it possible to set the L-side sheet guide 104 with a fine pitch. The pitch may be adjustable, and is not limited to 1/n.

Figure 6:
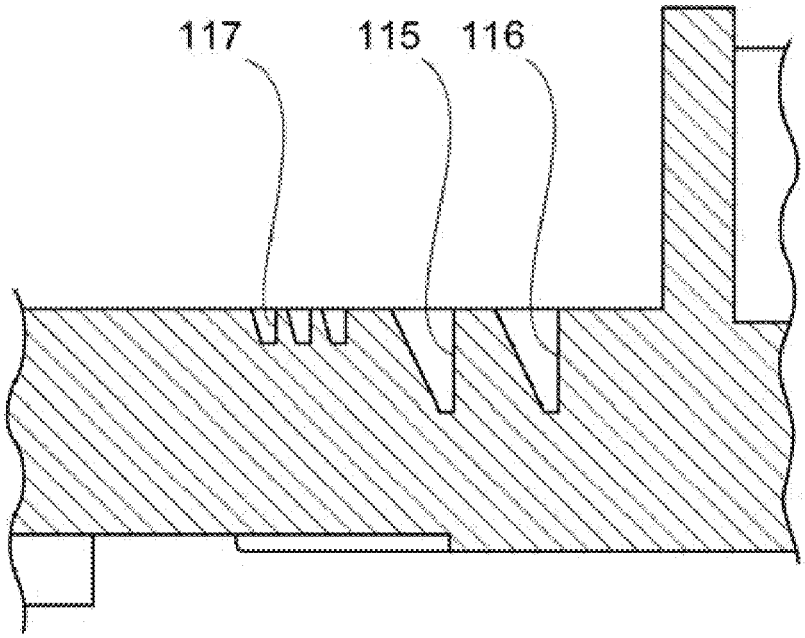
FIG. 6 is a schematic sectional view showing the first engaging groove group taken along a line 6-6 in FIG. 5 according to the first embodiment of the present invention.
Figure 7:
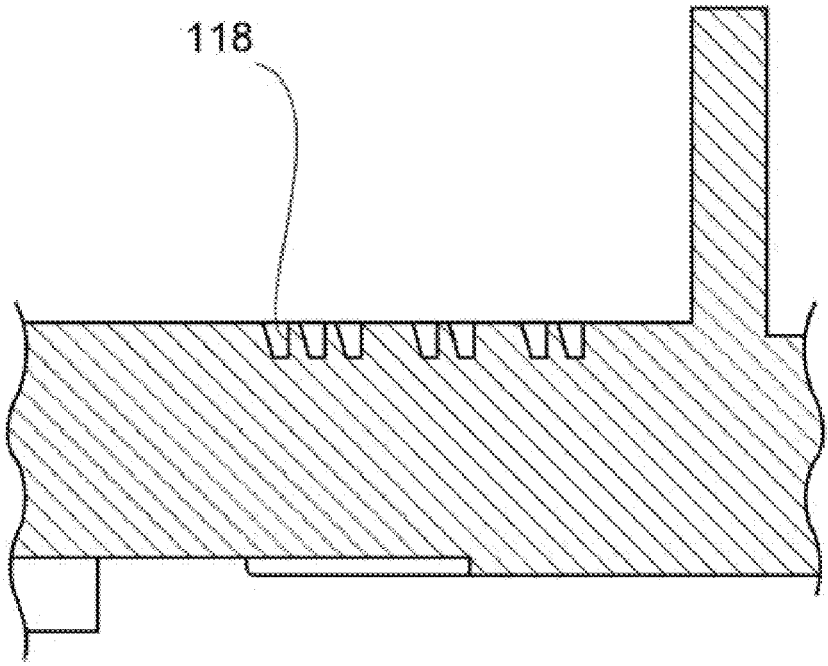
FIG. 7 is a schematic sectional view showing the second engaging groove group taken along a line 7-7 in FIG. 5 according to the first embodiment of the present invention.

FIG. 6 is a schematic sectional view showing the first engaging groove group 113 taken along a line 6-6 in FIG. 5 according to the first embodiment of the present invention. FIG. 7 is a schematic sectional view showing the second engaging groove group 114 taken along a line 7-7 in FIG. 5 according to the first embodiment of the present invention.

In the embodiment, the A4-size sheet groove 115 and the letter size sheet groove 116 of the first engaging group 113 for the standard size sheet have a depth greater than that of the first irregular size grooves 117 of the first engaging group 113 and the second irregular size grooves 118 of the second engaging groove group 114. Accordingly, it is easy to guide the L-side sheet guide 104 at the position for the standard size sheet.

Further, when the A4-size sheet groove 115 and the letter size sheet groove 116 for the standard size sheet have a greater depth, it is possible to securely position the L-side sheet guide 104 at the position for the standard size sheet used more frequently. Note that the R-side sheet guide 105 moves along with the L-side sheet guide 104 through the L-side rack 107, the pinion gear 109, and the R-side rack 108. Accordingly, the engaging groove group is not formed on the R (right) side of the sheet supply tray 101.

Figure 8:
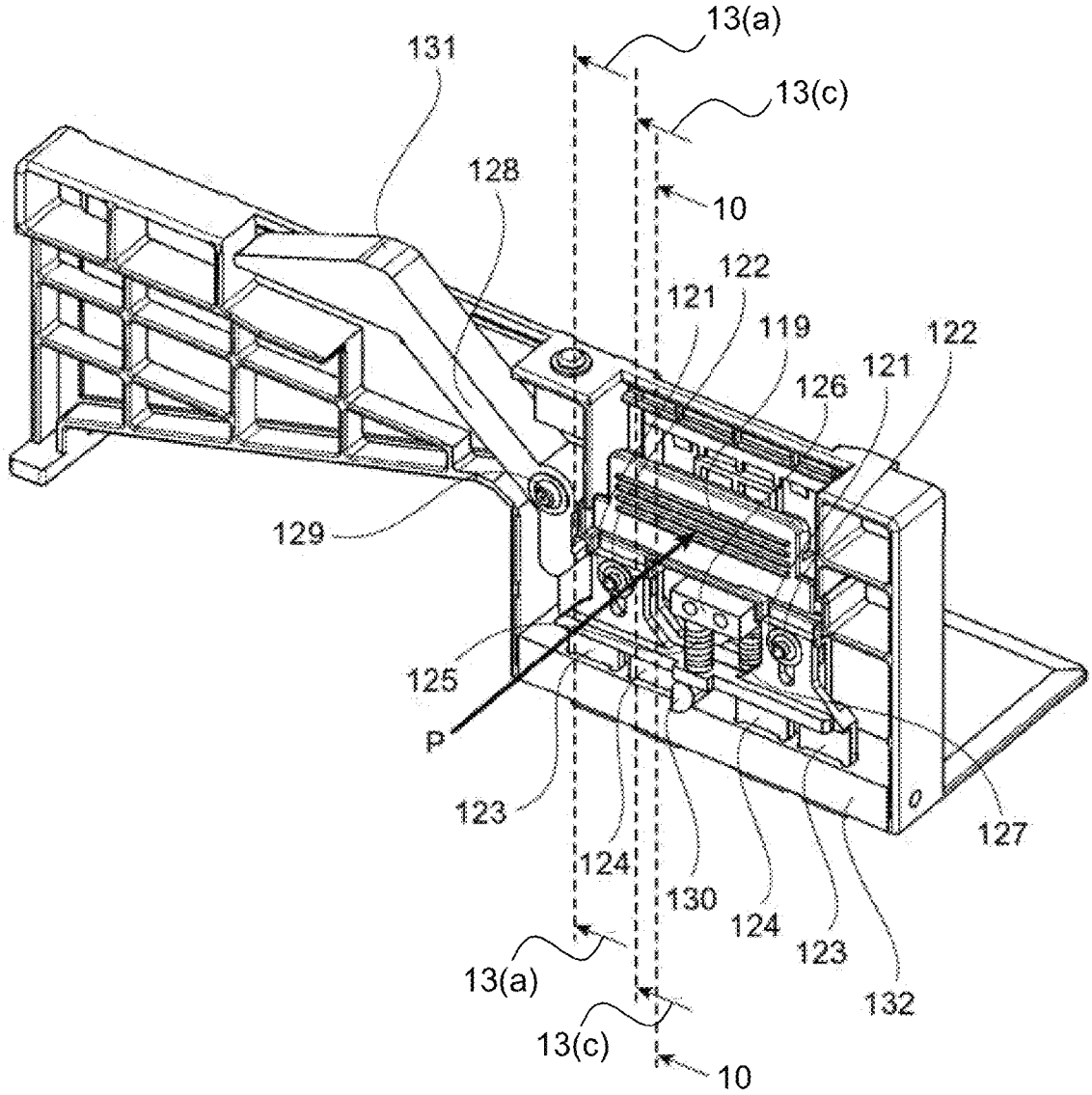
FIG. 8 is a perspective view showing an L-side sheet guide of the sheet supply tray according to the first embodiment of the present invention.
Figure 9:
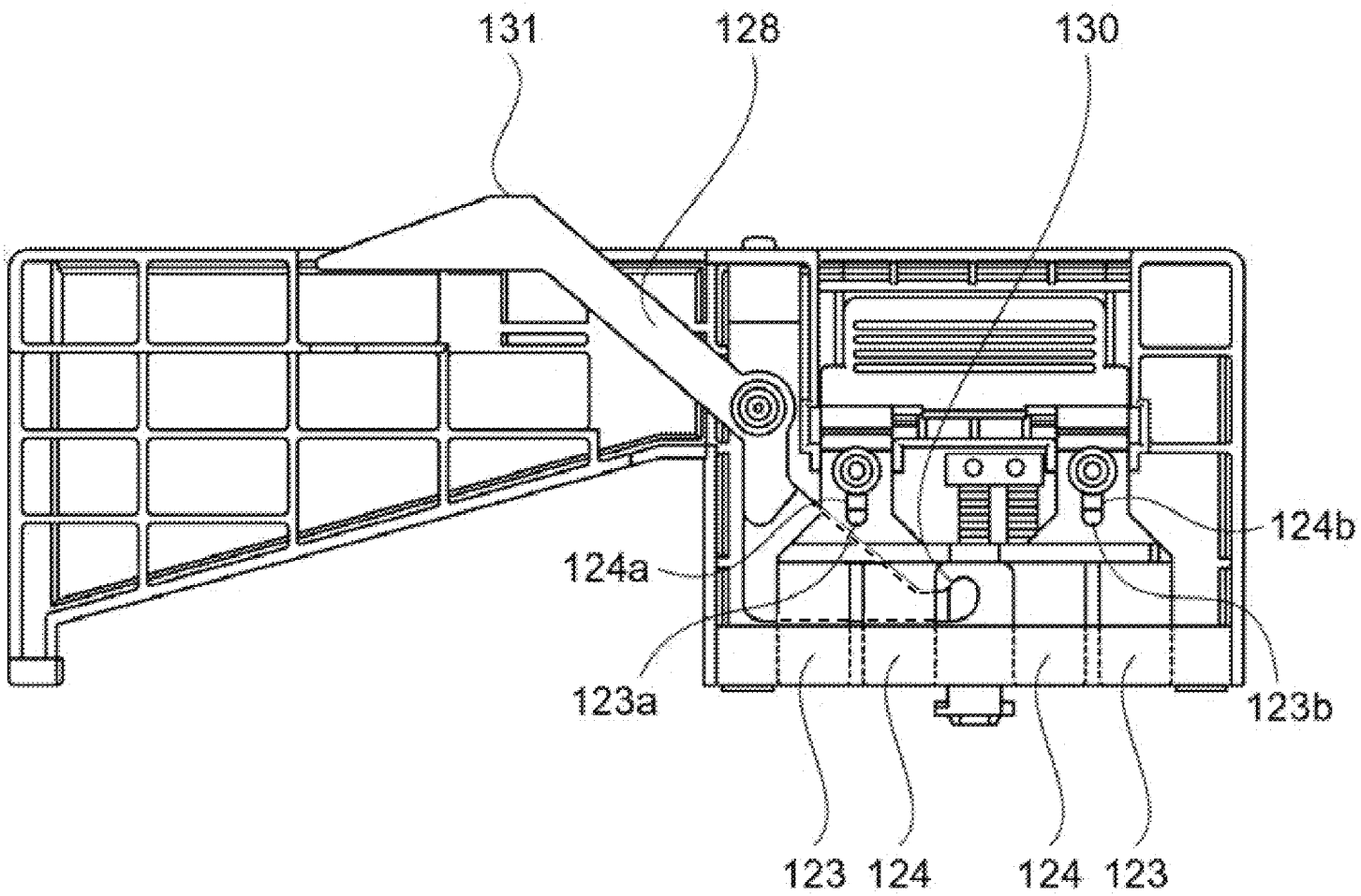
FIG. 9 is a side view showing the L-side sheet guide of the sheet supply tray according to the first embodiment of the present invention.

A configuration of the L-side sheet guide 104 will be explained next. FIG. 8 is a perspective view showing the L-side sheet guide 104 of the sheet supply tray 101 according to the first embodiment of the present invention. FIG. 9 is a side view showing the L-side sheet guide 104 of the sheet supply tray 101 according to the first embodiment of the present invention.

As shown in FIGS. 8 and 9, the L-side sheet guide 104 includes a lock release lever 119 as a first operation portion; a lock release lever rotational shaft 120 (described later); hanging pins 121; fixing portions 122; first engaging claws 123 as an engaging portion for engaging the first engaging groups 113; second engaging claws 124 as an engaging portion for engaging the second engaging groove groups 114; a first engaging claw pushing spring 125; a pushing spring holding portion 126; a second engaging claw pushing spring 127; a lock release bar 128 as a second operation portion; a rotational shaft 129; a pushing portion 130; a bar pushing portion 131; and a claw position fixing groove 132.

In the embodiment, when the lock release lever 119 is griped or pushed in an arrow direction P in FIG. 8, it is possible to disengage the first engaging claws 123 and the second engaging claws 124 from the first engaging groups 113 and the second engaging groove groups 114, respectively, so that the L-side sheet guide 104 can move to a specific position. When the lock release lever 119 is released and returns to an original position, the first engaging claws 123 and the second engaging claws 124 engage the first engaging groups 113 and the second engaging groove groups 114, respectively.

In the embodiment, the lock release lever 119 is formed of a material capable of deforming elastically such as polypropylene and the likes, and is attached to the lock release lever rotational shaft 120 provided on the L-side sheet guide 104. The hanging pin 121 formed of a metal bar member is fitted into the lock release lever 119. The fixing portions 122 are disposed on one end portion of the hanging pins 121 to prevent the first engaging claws 123 from being disengaged when the lock release lever 119 is griped.

In the embodiment, each of the first engaging claws 123 is formed of a plate member having an H character shape, and has a lower end portion having a sharp claw shape. Long holes 123*a* and 123*b* are formed in upper portions of the first engaging claws 123, so that the first engaging claws 123 are attached to the hanging pins 121 in a hanging state. The first engaging claw pushing spring 125 is disposed at an upper center portion of the first engaging claws 123 for engaging the first engaging claws 123 with the first engaging groups 113. The pushing spring holding portion 126 is formed as a part of the L-side sheet guide 104 above the first engaging claw pushing spring 125 for fixing the first engaging claw pushing spring 125.

Similar to the first engaging claws 123, each of the second engaging claws 124 is formed of a plate member having an H character shape, and has a lower end portion having a sharp claw shape. Long holes 124*a* and 124*b* are formed in upper portions of the second engaging claws 124, so that the second engaging claws 124 are attached to the hanging pins 121 in a hanging state. The second engaging claw pushing spring 127 is disposed at an upper center portion of the second engaging claws 124 for engaging the second engaging claws 124 with the second engaging groove groups 114. The pushing spring holding portion 126 is disposed above the second engaging claw pushing spring 127 for fixing the second engaging claw pushing spring 127. The first engaging claws 123 and the second engaging claws 124 are arranged linearly in a direction in parallel to the transportation direction of the sheet P.

In the embodiment, when the lock release bar 128 rotates, it is possible to disengage the first engaging claws 123 and the second engaging claws 124 from the first engaging groups 113 and the second engaging groove groups 114, respectively, so that the L-side sheet guide 104 can move to a specific position. When the lock release bar 128 is released and returns to an original position, the first engaging claws 123 and the second engaging claws 124 engage the first engaging groups 113 and the second engaging groove groups 114, respectively.

The lock release bar 128 is disposed to be rotatable around the rotational shaft 129. Further, the lock release bar 128 includes the pushing portion 130 at one end portion thereof, i.e., a position where the pushing portion 130 abuts against lower center portions of the first engaging claws 123 and the second engaging claws 124, and the bar pushing portion 131 having a gentle slope shape at the other end portion thereof.

In the embodiment, the claw position fixing groove 132 has a claw width the same as that of the first engaging claws 123 and the second engaging claws 124. Further, the claw position fixing groove 132 is disposed at a lower portion of the L-side sheet guide 104, so that the first engaging claws 123 and the second engaging claws 124 do not move in a direction perpendicular to the transportation direction of the sheet P.

Figure 10:
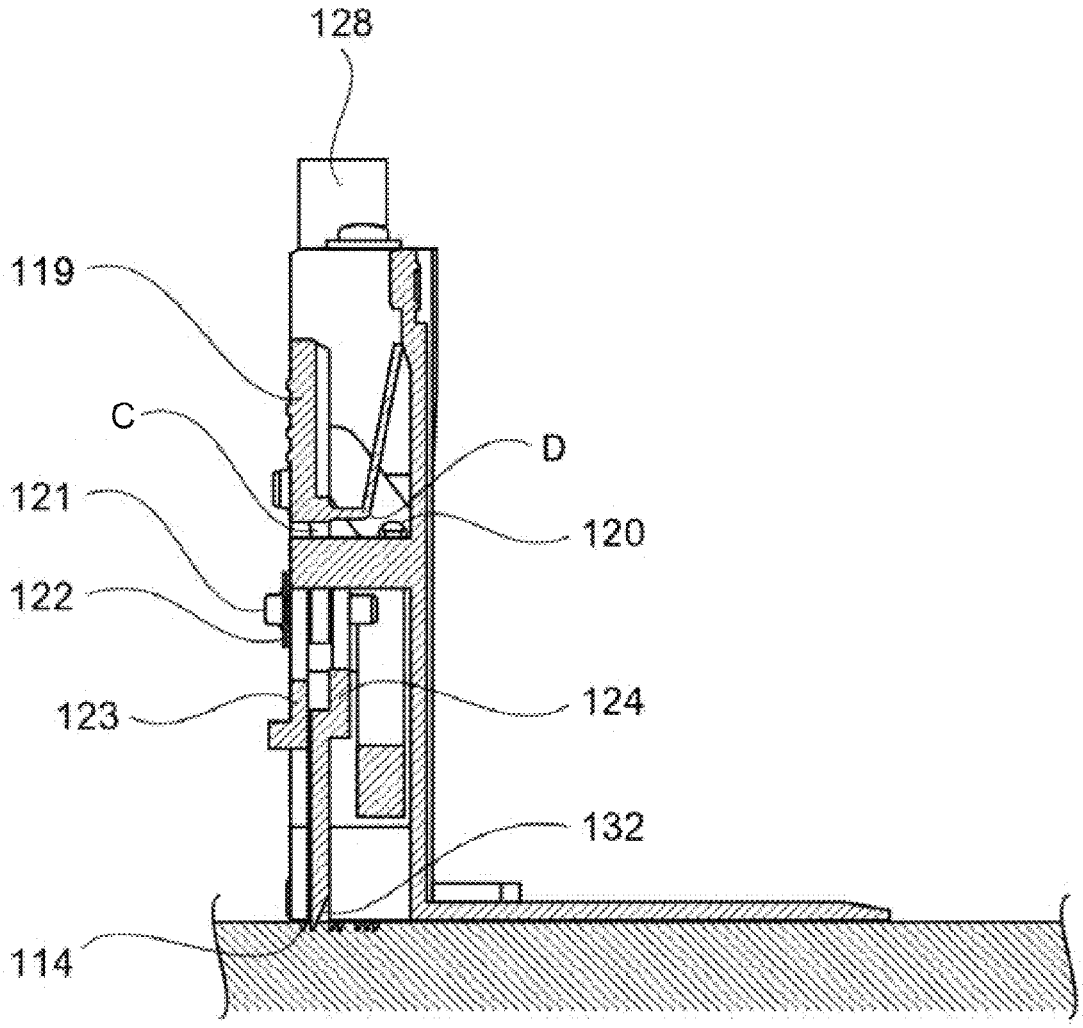
FIG. 10 is a schematic sectional view showing the L-side sheet guide of the sheet supply tray in a state that a second engaging claw engages the second engaging groove group taken along a line 10-10 in FIG. 8 according to the first embodiment of the present invention.

FIG. 10 is a schematic sectional view showing the L-side sheet guide 104 of the sheet supply tray 101 in a state that the second engaging claw 124 engages the second engaging groove group 114 taken along a line 10-10 in FIG. 8 according to the first embodiment of the present invention. As shown in FIG. 10, the second engaging claw 124 engages the second engaging groove group 114, so that the L-side sheet guide 104 is fixed.

Figure 11:
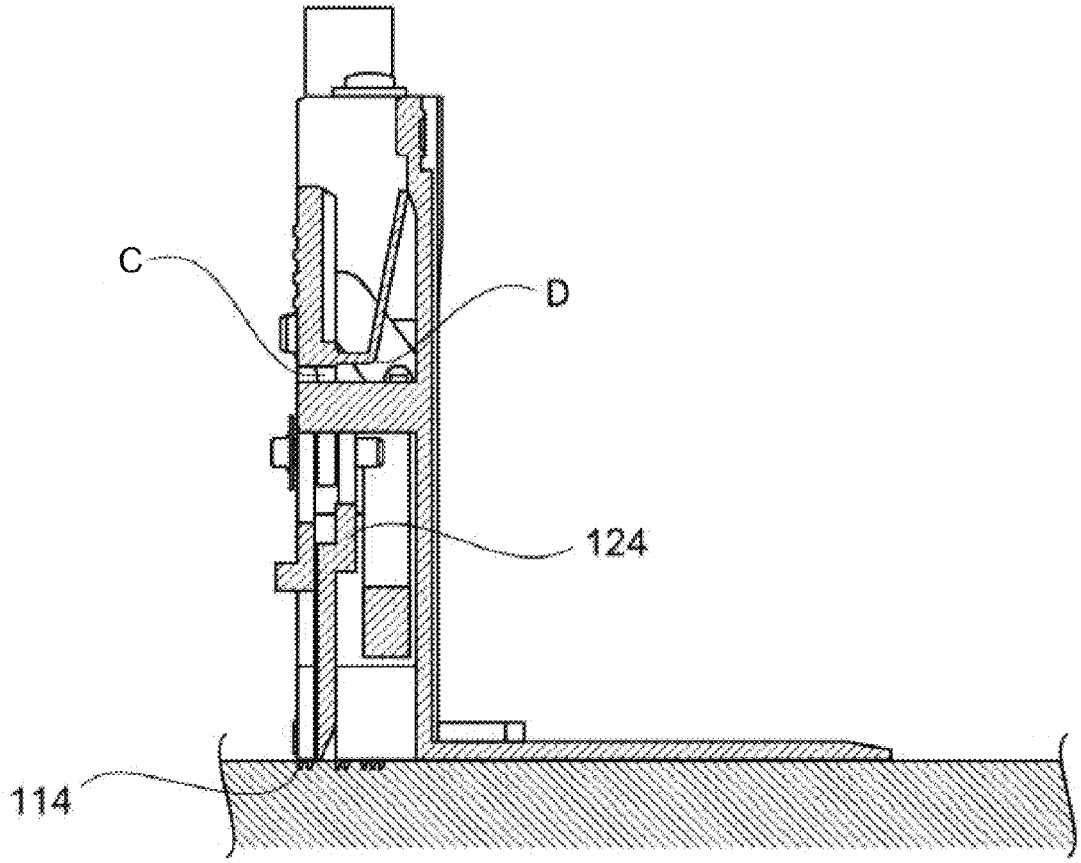
FIG. 11 is a schematic sectional view showing the L-side sheet guide of the sheet supply tray in a state that the second engaging claw is disengaged from the second engaging groove group taken along the line 10-10 in FIG. 8 according to the first embodiment of the present invention.

FIG. 11 is a schematic sectional view showing the L-side sheet guide 104 of the sheet supply tray 101 in a state that the second engaging claw 124 is disengaged from the second engaging groove group 114 taken along the line 10-10 in FIG. 8 according to the first embodiment of the present invention. As shown in FIG. 11, when the second engaging claw 124 is disengaged from the second engaging groove group 114, it is possible to move the L-side sheet guide 104 to a specific position.

Figure 12:
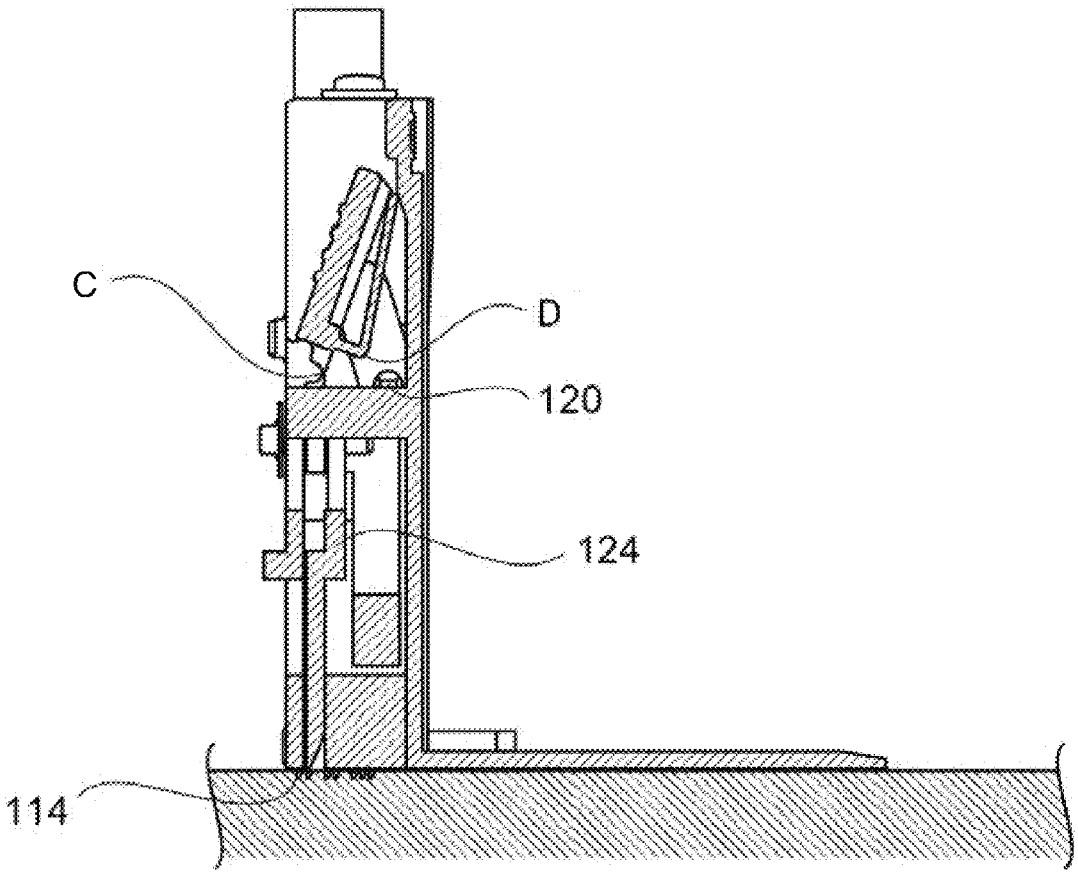
FIG. 12 is a schematic sectional view showing the L-side sheet guide of the sheet supply tray in another state that the second engaging claw is disengaged from the second engaging groove group taken along the line 10-10 in FIG. 8 according to the first embodiment of the present invention.
Figure 13A:
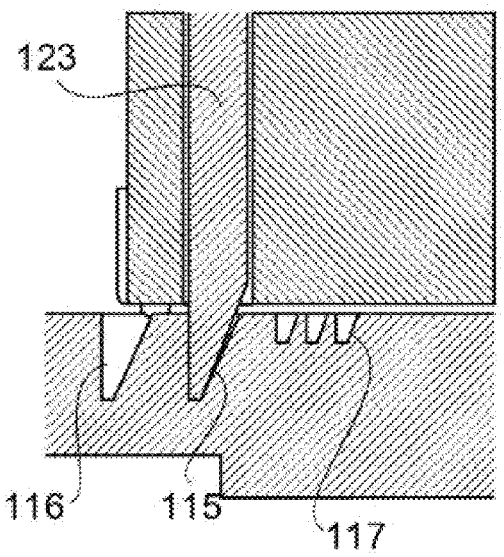
FIGS. 13(*a*) and 13(*b*) are schematic enlarged views showing the first engaging claw in a first state that the first engaging claw engages the first engaging groove group and a second state that the first engaging claw is disengaged from the first engaging groove group taken along a line 13(*a*)-13(*a*) in FIG. 8 according to the first embodiment of the present invention.
Figure 13B:
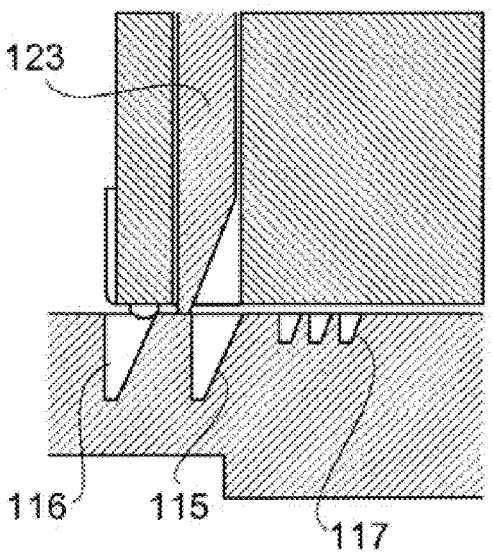
Figure 13C:
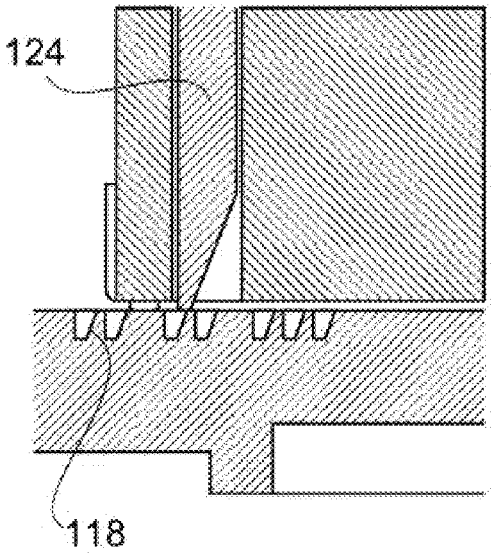
Figure 13D:
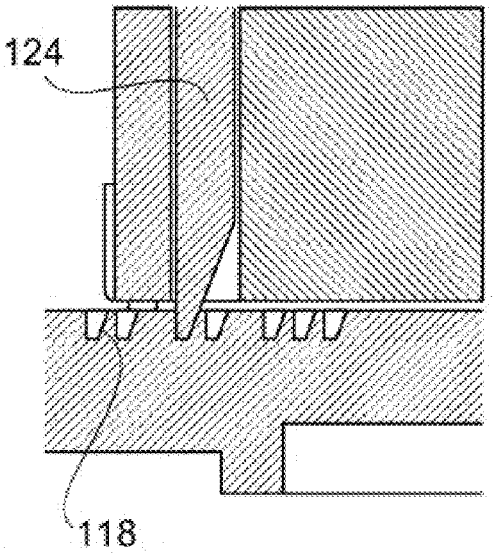

FIG. 12 is a schematic sectional view showing the L-side sheet guide 104 of the sheet supply tray 101 in another state that the second engaging claw 124 is disengaged from the second engaging groove group 114 taken along the line 10-10 in FIG. 8 according to the first embodiment of the present invention. As shown in FIG. 12, when the lock release lever 119 is gripped or pushed in the arrow direction P in FIG. 8, it is possible to disengage the second engaging claws 124 from the second engaging groove groups 114, so that the L-side sheet guide 104 can move to a specific position. When the lock release lever 119 is released and returns to an original position, the first engaging claws 123 and the second engaging claws 124 engage the first engaging groups 113 and the second engaging groove groups 114, respectively.

FIGS. 13(*a*) and 13(*b*) are schematic enlarged views showing the first engaging claw 123 in a first state that the first engaging claw 123 engages the A4-size sheet groove 115 of the first engaging groove group 113 and a second state that the first engaging claw 123 is engaged from the A4-size sheet groove 115 of the first engaging groove group 113 taken along a line 13(*a*)-13(*a*) in FIG. 8 according to the first embodiment of the present invention.

FIGS. 13(*c*) and 13(*d*) are schematic enlarged views showing the second engaging claw 124 in a third state that the second engaging claw 124 engages the second irregular size grooves 118 of the second engaging groove group 114 and a fourth state that the second engaging claw 124 is disengaged from the second irregular size grooves 118 of the second engaging groove group 114 taken along a line 13(*c*)-13(*c*) in FIG. 8 according to the first embodiment of the present invention.

As shown in FIGS. 13(*a*) to 13(*d*), when the first engaging claws 123 engages the A4-size sheet groove 115, the second engaging claw 124 doe not engage the second irregular size grooves 118. On the other hand, when the second engaging claws 124 engages the second irregular size grooves 118, the first engaging claw 123 does not engage the A4-size sheet groove 115. As described above, the first engaging group 113 is disposed away from the second engaging groove group 114 by ½ t in the width direction of the sheet P. Accordingly, the first engaging claws 123 and the second engaging claws 124 arranged linearly do not engage simultaneously in the direction in parallel to the transportation direction of the sheet P.

Figure 14:
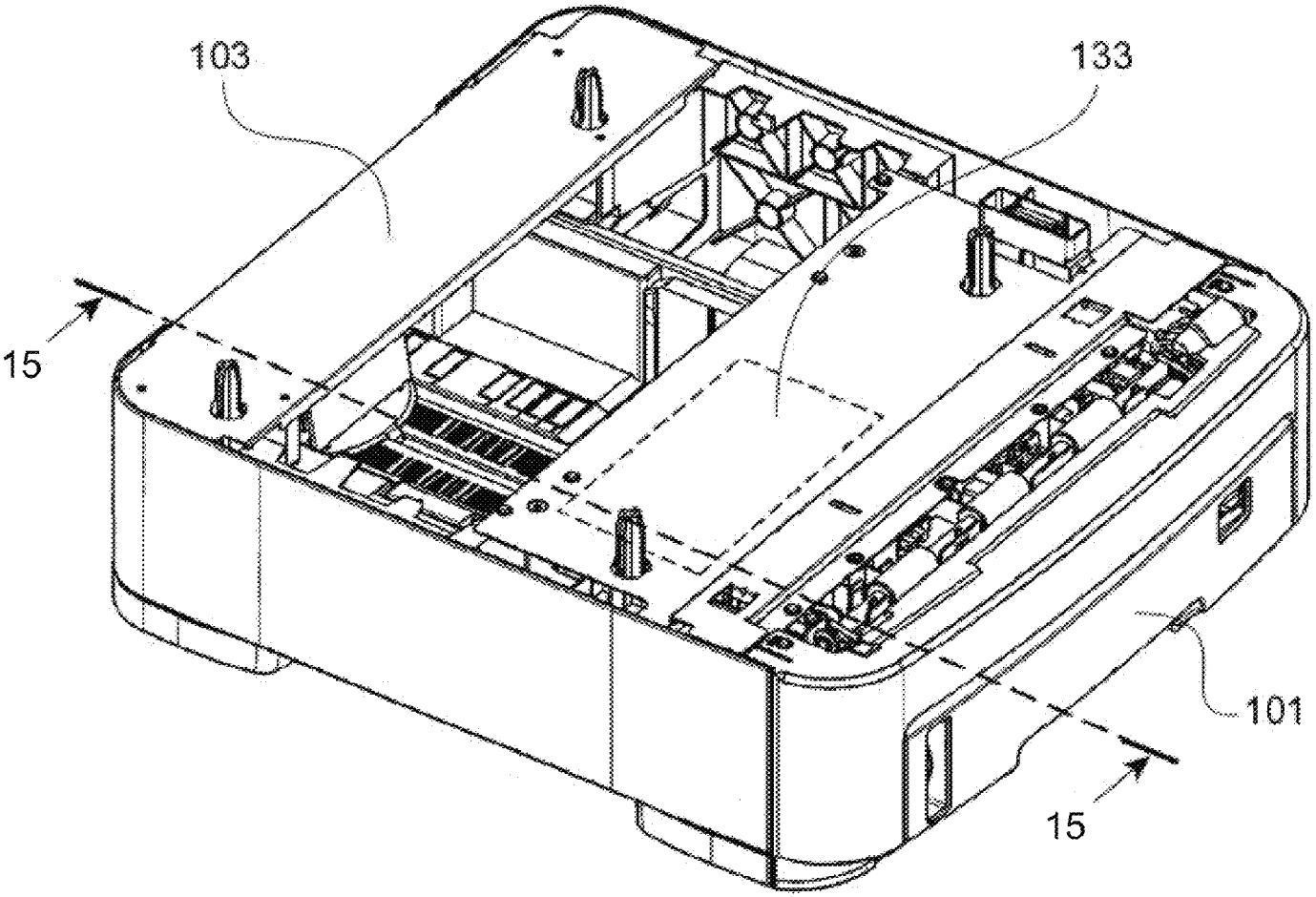
FIG. 14 is a perspective view showing an expansion sheet supply apparatus according to the first embodiment of the present invention.
Figure 15:
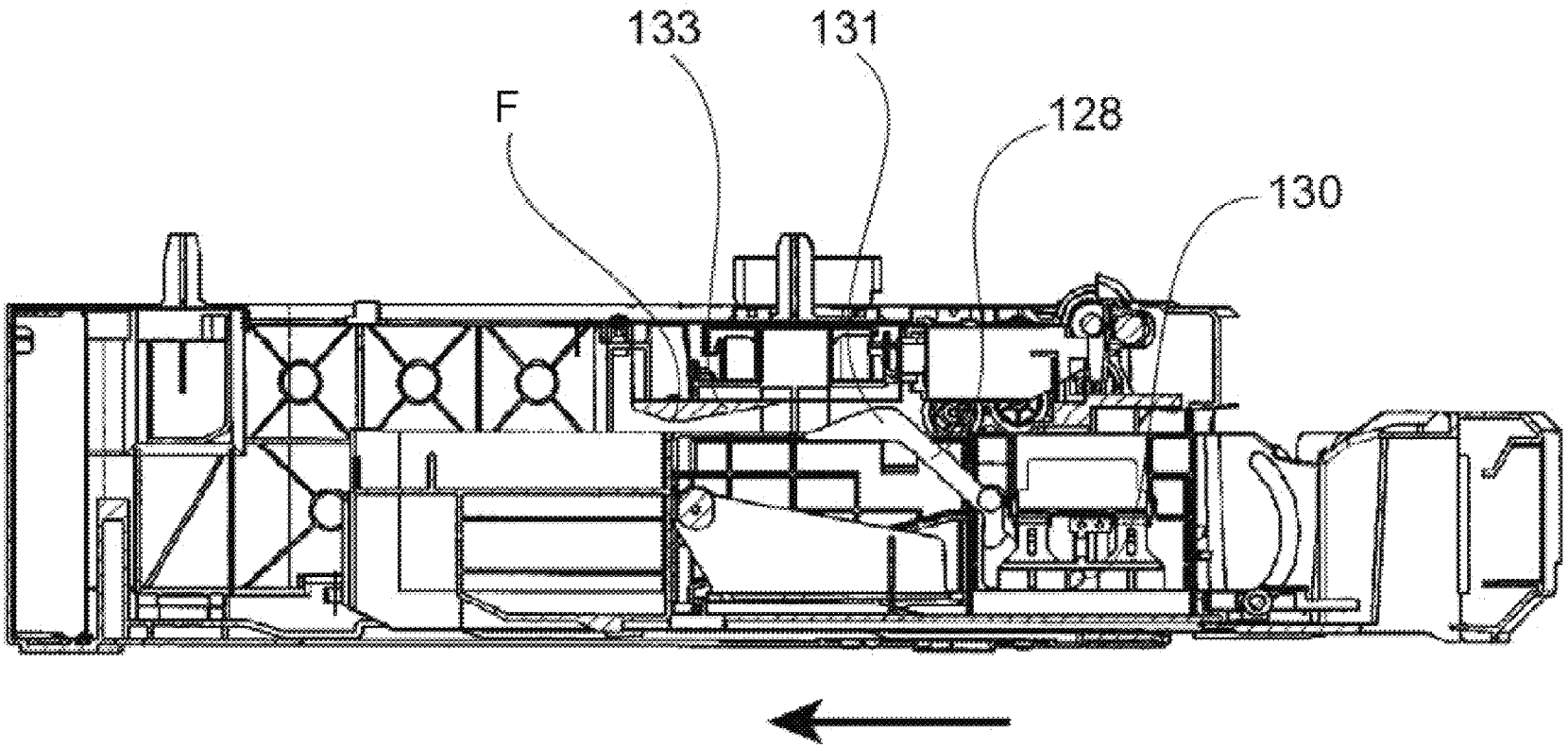
FIG. 15 is a sectional view showing the expansion sheet supply apparatus in a state that the sheet supply tray is inserted to the expansion sheet supply apparatus taken along a line 15-15 in FIG. 14 according to the first embodiment of the present invention.

Next, the expansion sheet supply apparatus 103 to which the sheet supply tray 101 is detachably attached will be explained with reference to FIGS. 13 to 17. FIG. 14 is a perspective view showing the expansion sheet supply apparatus 103 according to the first embodiment of the present invention. FIG. 15 is a sectional view showing the expansion sheet supply apparatus 103 in a state that the sheet supply tray 101 is inserted to the expansion sheet supply apparatus 103 taken along a line 15-15 in FIG. 14 according to the first embodiment of the present invention.

Figure 16:
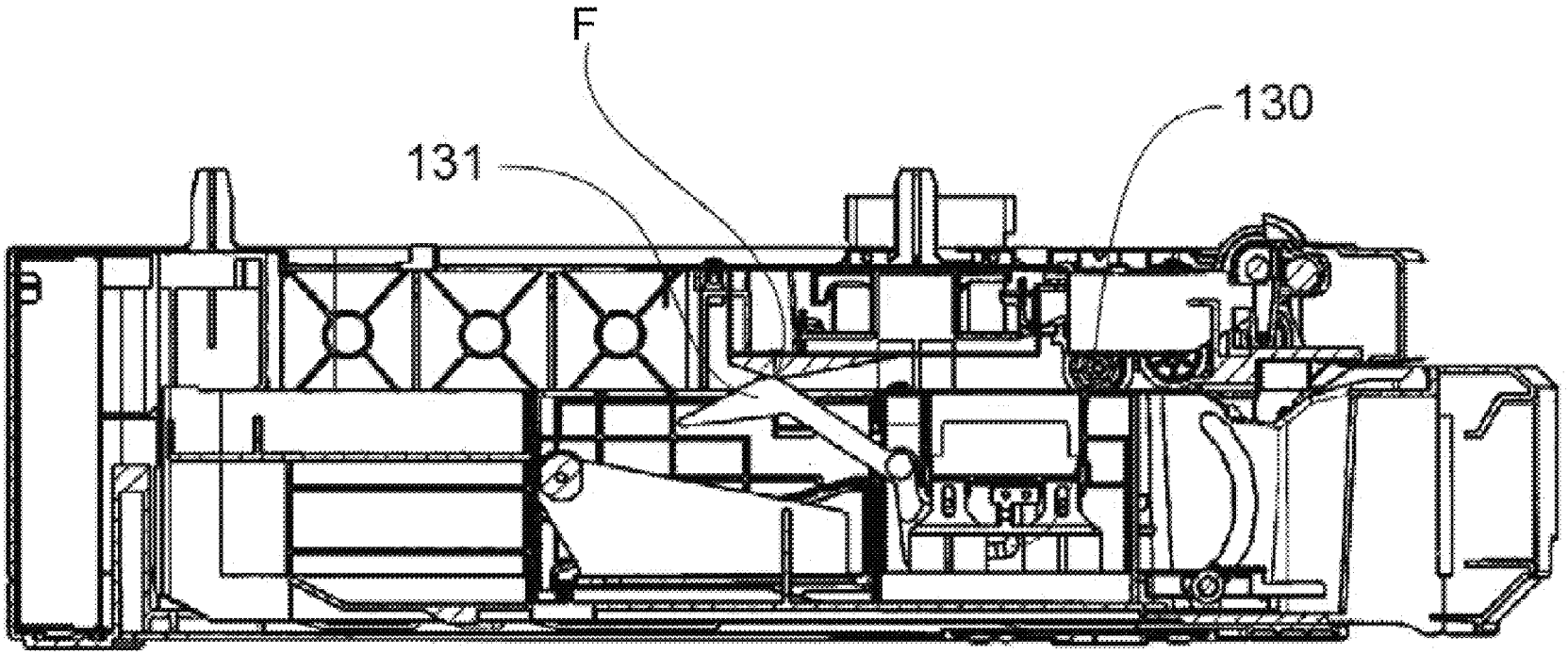
FIG. 16 is a sectional view showing the expansion sheet supply apparatus in another state that the sheet supply tray is inserted to the expansion sheet supply apparatus taken along the line 15-15 in FIG. 14 according to the first embodiment of the present invention.
Figure 17:
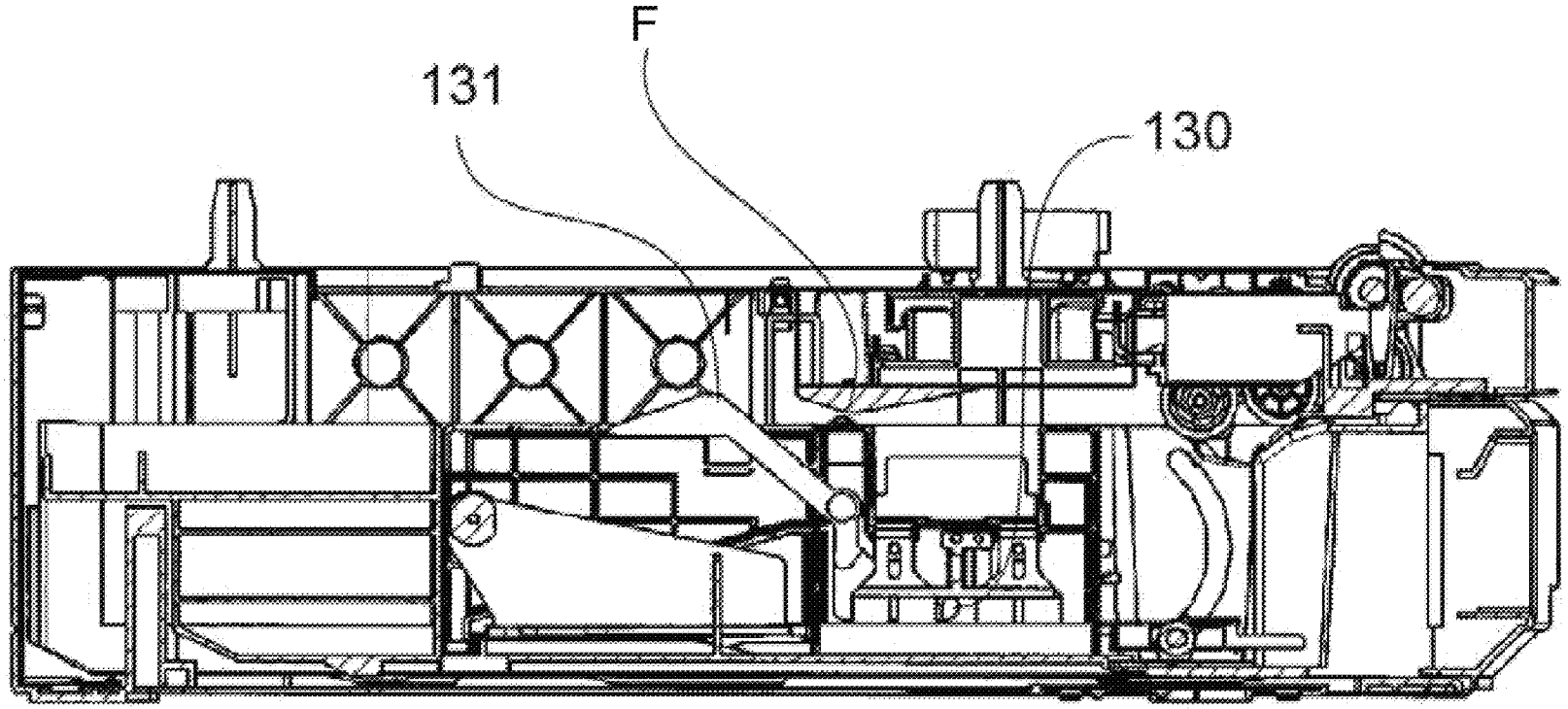
FIG. 17 is a sectional view showing the expansion sheet supply apparatus in a state that the sheet supply tray is attached to the expansion sheet supply apparatus taken along the line 15-15 in FIG. 14 according to the first embodiment of the present invention.

FIG. 16 is a sectional view showing the expansion sheet supply apparatus 103 in another state that the sheet supply tray 101 is inserted to the expansion sheet supply apparatus 103 taken along the line 15-15 in FIG. 14 according to the first embodiment of the present invention. FIG. 17 is a sectional view showing the expansion sheet supply apparatus 103 in a state that the sheet supply tray 101 is attached to the expansion sheet supply apparatus 103 taken along the line 15-15 in FIG. 14 according to the first embodiment of the present invention.

As shown in FIGS. 14 and 15, the expansion sheet supply apparatus 103 has a pushing member 133 as an abutting portion having a protruded shape with a gentle slope. The pushing member 133 is situated at a position to contact with the lock release bar 128 when the sheet supply tray 101 is inserted into the expansion sheet supply apparatus 103. The pushing member 133 extends in a direction perpendicular to the transportation direction of the sheet P, and has a lateral length corresponding to a moving range of the L-side sheet guide 104 in a width direction thereof.

In the embodiment, the pushing member 133 has a longitudinal length corresponding to a half of the moving range of the L-side sheet guide 104 in a longitudinal direction thereof. When it is necessary to release the engagement for placing a sheet having a specific size, it is sufficient that the L-side sheet guide 104 is fixed at a position corresponding to a width of the sheet.

As shown in FIGS. 15 to 17, when the sheet supply tray 101 is inserted into the expansion sheet supply apparatus 103, the pushing member 133 contacts with the lock release bar 128. When the sheet supply tray 101 is completely attached to the expansion sheet supply apparatus 103, the pushing member 133 does not contact with the lock release bar 128.

In the embodiment, the lock release bar 128 is configured to push up the pushing portion 130 by 4.5 mm when the pushing member 133 pushes down the bar pushing portion 131 by 5.5 mm. Note that a position of the sheet supply tray 101 where the pushing member 133 pushes down the lock release bar 128 is a first position, and a position of the sheet supply tray 101 when the sheet supply tray 101 is completely inserted is a second position.

A printing operation of the printer 400 having the sheet supply tray 101 and the expansion sheet supply apparatus 103 described above will be explained next.

According to a print instruction from the print control unit (not shown), when the drive source (not shown) drives the sheet supply roller 401 to rotate, the hopper 402 pushes up the sheet P from the sheet supply tray 101, so that the sheet supply roller 401 transports the sheet P to the transport roller 403L. At this moment, even when a plurality of sheets is picked up due to friction between the sheets, the sheet separation member 112 separates the sheets, so that it is possible to transport the sheet P one by one.

When the sheet supply roller 401 transports the sheet P, the transport rollers 403L and 403U transport the sheet P along the transportations path S to the image forming unit 404 while correcting skew of the sheet P. Then, the image forming unit 404 forms the developer image on the sheet P according to the print data input thereto. After the developer image is formed on the sheet P, the sheet P is transported to the fixing unit 407.

When the sheet P is transported to the fixing unit 407, the fixing unit 407 applies heat and pressure to the sheet P when the sheet P passes through the nip portion between the heating roller 407*a* and the fixing belt 407*b*, so that the developer image is fixed to the sheet P.

After the sheet P passes through the fixing unit 407, the sheet P is transported to the discharge roller 408. The drive source (not shown) drives the discharge roller 408 to rotate, so that the discharge roller 408 transports the sheet P to the medium discharge portion 409. Then, the medium discharge portion 409 discharges the sheet P to the medium stacker 410, thereby completing the printing operation of the printer 400.

An operation of the sheet supply tray 101 and the expansion sheet supply apparatus 103 will be explained next. First, an operation of setting the sheet P in the sheet supply tray 101 will be explained.

When the sheet P is set in the sheet supply tray 101, first, the sheet supply tray 101 is detached from the expansion sheet supply apparatus 103. Then, the L-side sheet guide 104 and the R-side sheet guide 105 move along the side guide slide grooves 106 according to the size of the sheet P. At this moment, the L-side rack 107 fixed to the L-side sheet guide 104 is connected to the R-side rack 108 fixed to the R-side sheet guide 105. Accordingly, the R-side sheet guide 105 moves together with the L-side sheet guide 104.

In the embodiment, the lock release lever 119 is gripped or pushed in the arrow direction P in FIG. 8, so that the second engaging claws 124 are disengaged from the second engaging groove groups 114 to move the L-side sheet guide 104. At this moment, as shown in FIG. 10, the lock release lever 119 elastically deforms at a portion C and a portion D around the lock release lever rotational shaft 120, so that the hanging pins 121 fixed to the lock release lever 119 move vertically. When the hanging pins 121 move upward, the hanging pins 121 contact upper portions of the long holes 123*a* and 123*b* formed in the first engaging claws 123, thereby lifting the first engaging claws 123. Similar to the first engaging claws 123, the second engaging claws 124 are lifted as well.

When the first engaging claws 123 and the second engaging claws 124 are lifted, the first engaging claws 123 are disengaged from the first engaging groups 113, and the second engaging claws 124 are disengaged from the second engaging groove groups 114. While maintaining the state, the L-side sheet guide 104 and the R-side sheet guide 105 move to the positions corresponding to the size of the sheet P, and the lock release lever 119 is released when the distance between the L-side sheet guide 104 and the R-side sheet guide 105 becomes equal to the width of the sheet P.

When the lock release lever 119 is released and the elastic deformation at the portion C and the portion D returns to an original state, the hanging pins 121 fixed to the lock release lever 119 move downward. Accordingly, the first engaging claws 123 and the second engaging claws 124 engage the first engaging groups 113 and the second engaging groove groups 114, respectively. At this moment, the hanging pins 121 do not contact upper portions of the long holes 123*a*, 123*b*, 124*a*, and 124*b*. Accordingly, when the lock release lever 119 is released, the first engaging claws 123 and the second engaging claws 124 do not move.

An operation of setting the sheet supply tray 101 to the expansion sheet supply apparatus 103 will be explained next. FIG. 15 is a sectional view showing the expansion sheet supply apparatus 103 in a state that the sheet supply tray 101 is inserted to the expansion sheet supply apparatus 103 taken along a line 15-15 in FIG. 14 according to the first embodiment of the present invention. In the state shown in FIG. 15, the lock release bar 128 is situated at a front position relative to a position F where the lock release bar 128 contacts with the pushing member 133.

FIG. 16 is a sectional view showing the expansion sheet supply apparatus 103 in another state that the sheet supply tray 101 is inserted to the expansion sheet supply apparatus 103 taken along the line 15-15 in FIG. 14 according to the first embodiment of the present invention. In the state shown in FIG. 16, the lock release bar 128 contacts with the pushing member 133.

FIG. 17 is a sectional view showing the expansion sheet supply apparatus 103 in a state that the sheet supply tray is attached to the expansion sheet supply apparatus taken along the line 15-15 in FIG. 14 according to the first embodiment of the present invention. In the state shown in FIG. 17, the lock release bar 128 is situated at a rear position relative to the position F where the lock release bar 128 contacts with the pushing member 133.

The state shown in FIG. 13(*a*), in which the first engaging claws 123 engage the first engaging groups 113, will be explained. When the hanging pins 121 move downward, the first engaging claw pushing spring 125 pushes down the first engaging claws 123. In this case, the first engaging claws 123 engage the A4-size sheet grooves 115 of the first engaging groups 113. At this moment, the second engaging claw pushing spring 127 pushes down the second engaging claws 124 as well. As described above, the first engaging groups 113 are disposed away from the second engaging groove groups 114 by the distance ½ t. Accordingly, when the first engaging claws 123 engage the first engaging groups 113, the second engaging claws 124 does not fit in and engage the second engaging groove groups 114.

In the state described above, the sheet P is set in the sheet supply tray 101, and the sheet supply tray 101 is inserted into the expansion sheet supply apparatus 103 as shown in FIG. 15. Then, as shown in FIG. 16, the sheet supply tray 101 is inserted further into the expansion sheet supply apparatus 103, and the lock release bar 128 contacts with the pushing member 133 at the position F, so that the bar pushing portion 131 is pushed down. At this moment, the lock release bar 128 rotates around the rotational shaft 129, so that the pushing portion 130 rotates upward. Accordingly, the pushing portion 130 pushes up the center portions of the first engaging claws 123 and the second engaging claws 124, thereby disengaging the L-side sheet guide 104.

In this state, when the distance between the surfaces of the L-side sheet guide 104 and the R-side sheet guide 105 contacting with the edges of the sheet P is smaller than the width of the sheet P, the L-side sheet guide 104 and the R-side sheet guide 105 are pushed sideway in the width direction of the sheet P due to rigidity of the sheet P. Accordingly, the L-side sheet guide 104 automatically moves according to the width of the sheet P until the L-side sheet guide 104 is situated at an appropriate position by an interval of the distance ½ t. As described above, the L-side rack 107 fixed to the L-side sheet guide 104 is connected to the R-side rack 108 fixed to the R-side sheet guide 105 through the pinion gear 109. Accordingly, when the L-side sheet guide 104 moves, the R-side sheet guide 105 moves as well.

When the lock release bar 128 passes the position F as shown in FIG. 17 to become the state shown in FIG. 13(*b*), the first engaging claw pushing spring 125 pushes down the first engaging claws 123, and the second engaging claw pushing spring 127 pushes down the second engaging claws 124. Accordingly, ones of the first engaging claws 123 and the second engaging claws 124 engage the first engaging groups 113 or the second engaging groove groups 114, thereby completing the operation of setting the sheet P in the sheet supply tray 101.

As described above, in the embodiment, the standard size includes the A-4 size and the letter size. When the first engaging claws 123 and the second engaging claws 124 are provided according to other sizes of the sheet P, it is possible to apply the configuration to other standard sizes.

Further, as described above, in the embodiment, when the lock release bar 128 contacts with the pushing member 133, the first engaging claws 123 and the second engaging claws 124 are lifted and disengaged from the first engaging groups 113 and the second engaging groove groups 114, respectively. The present invention is not limited to the embodiment, and may be modified.

Figure 18:
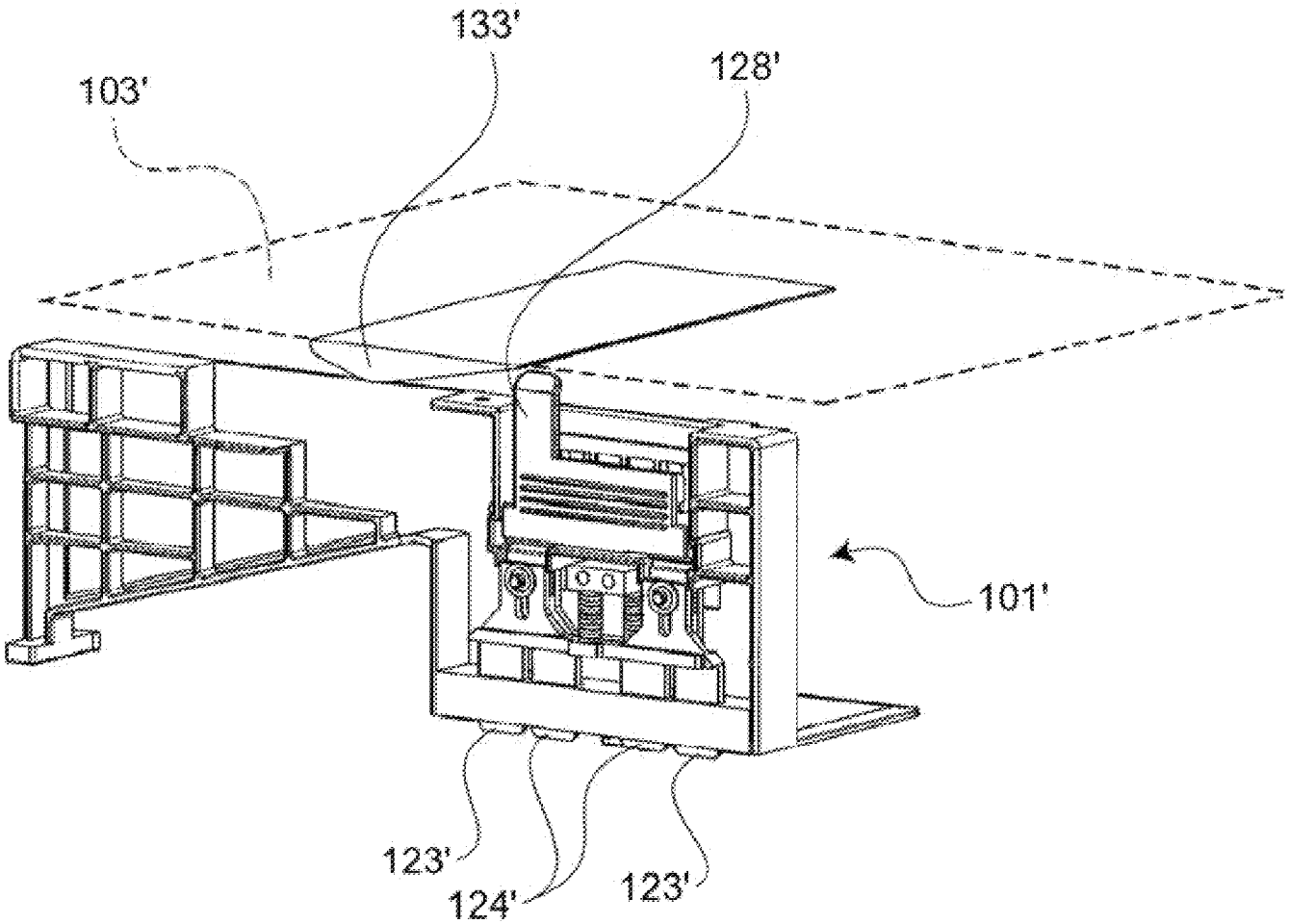
FIG. 18 is a perspective view showing a modified example of the sheet supply tray according to the first embodiment of the present invention.
Figure 19:
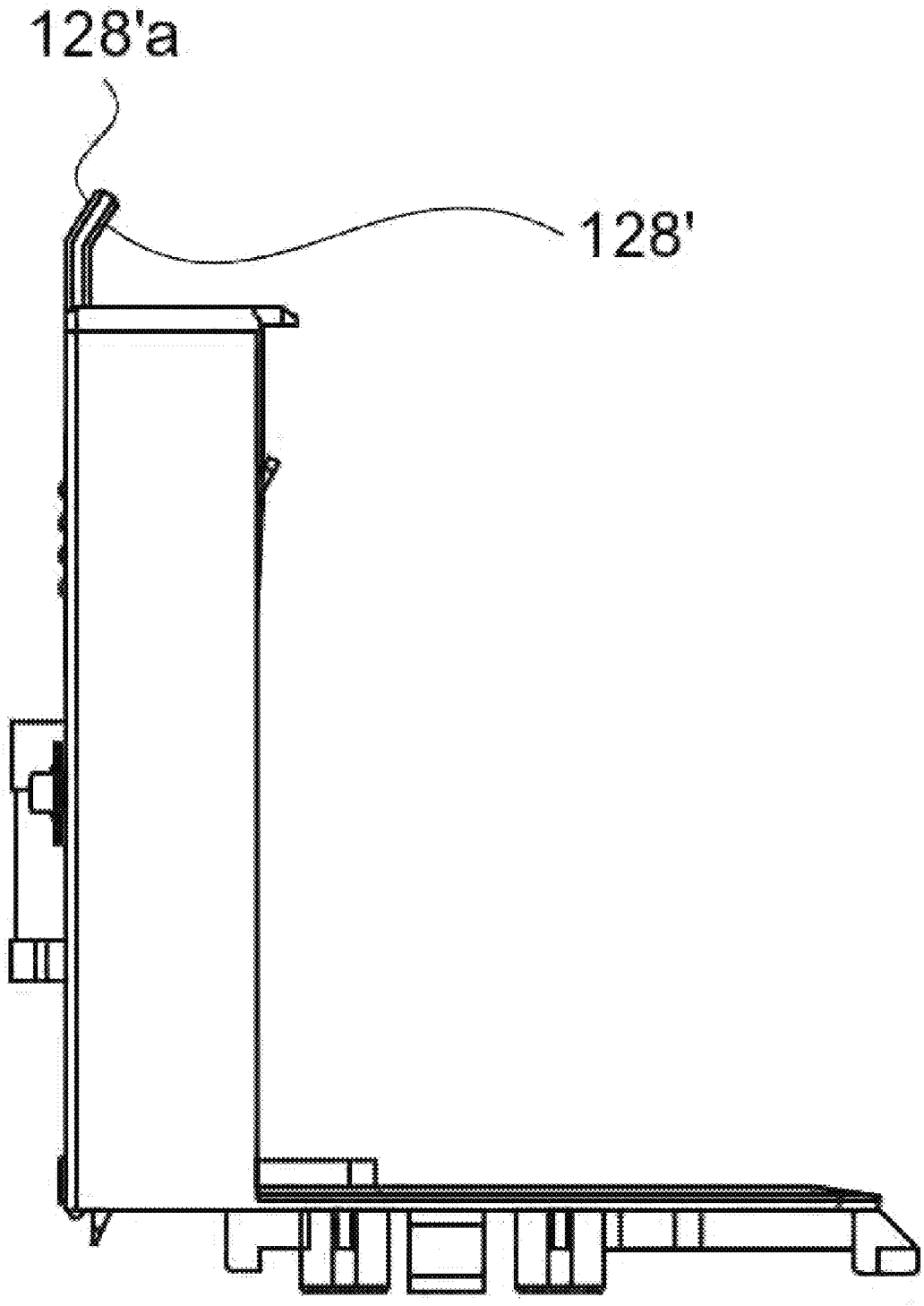
FIG. 19 is a side view showing the modified example of the sheet supply tray according to the first embodiment of the present invention.

FIG. 18 is a perspective view showing a modified example of a sheet supply tray 101' according to the first embodiment of the present invention. FIG. 19 is a side view showing the modified example of the sheet supply tray 101' according to the first embodiment of the present invention.

As shown in FIGS. 18 and 19, in the modified example, a grip portion of a lock lease lever 128' partially extends in a height direction thereof. When the sheet supply tray 101' is set to an expansion sheet supply apparatus 103', the grip portion contact with a pushing member 133' disposed on the expansion sheet supply apparatus 103'. The lock lease lever 128' has an inclined portion 128'*a* at a distal end portion thereof. The inclined portion 128'*a* is bent in a direction the same as that the lock lease lever 128' moves upon being gripped.

With the configuration described above, when the sheet supply tray 101' is set to the expansion sheet supply apparatus 103', the inclined portion 128'*a* of the lock lease lever 128' contacts with the pushing member 133'. Accordingly, the lock lease lever 128' moves in an inclined direction of the inclined portion 128'*a*, i.e., the direction that the lock lease lever 128' is gripped with a finger. As a result, similar to the case that the lock lease lever 128' is gripped, first engaging claws 123' and second engaging claws 124' are lifted and disengaged. Accordingly, in the modified example, it is possible to obtain an effect similar to that in the first embodiment while reducing a number of parts.

In the embodiment described above, the expansion sheet supply apparatus 103 is explained as an example of the sheet supply apparatus, and the sheet supply apparatus may be applied to a sheet supply apparatus disposed in a main body of an image forming apparatus. Further, in the embodiment, the first engaging groups 113, the second engaging groove groups 114, the first engaging claws 123, and the second engaging claws 124 are formed of a plurality of groups. Further, the first engaging claws 123 and the second engaging claws 124 have a thickness the same as that of one group, and the first engaging groups 113 and the second engaging groove groups 114 have the width the same as that of one group. Accordingly, as compared to one group, it is possible to engage with a fine pitch without reducing a locking force.

As described above, in the embodiment, when the sheet supply tray 101 is set to the expansion sheet supply apparatus 103, the L-side sheet guide 104 of the sheet supply tray 101 is disengaged. Then, the L-side sheet guide 104 moves to the position corresponding to the width of the sheet P, and is locked at the position. Accordingly, when a sheet having a size larger than the position where the L-side sheet guide 104 is set in the sheet supply tray 101, it is possible to automatically reset the L-side sheet guide 104 to the position where the L-side sheet guide 104 does not interfere with the transportation of the sheet. Further, when the L-side sheet guide 104 is set to the position corresponding to the standard size, and a sheet having a size slightly larger than the standard size, it is possible to reset the L-side sheet guide 104 to the position where the L-side sheet guide 104 does not interfere with the transportation of the sheet.

Further, in the embodiment, when the L-side sheet guide 104 is set to the standard sheet size, the L-side sheet guide 104 moves to the position corresponding to the actual width of the sheet P. Accordingly, even when the sheet P has a variance in the width thereof, it is possible to stably supply the sheet P without paper jam due to excessive friction between the contact surface of the L-side sheet guide 104 and the edge of the sheet P during the transportation of the sheet P.

Second Embodiment

A second embodiment of the present invention will be explained next. In the second embodiment, the printer 400, a sheet supply tray 201, and the expansion sheet supply apparatus 103 have configurations similar to those in the first embodiment. Accordingly, similar components are designated with the same reference numerals, and only differences from the first embodiment will be explained.

Figure 20:
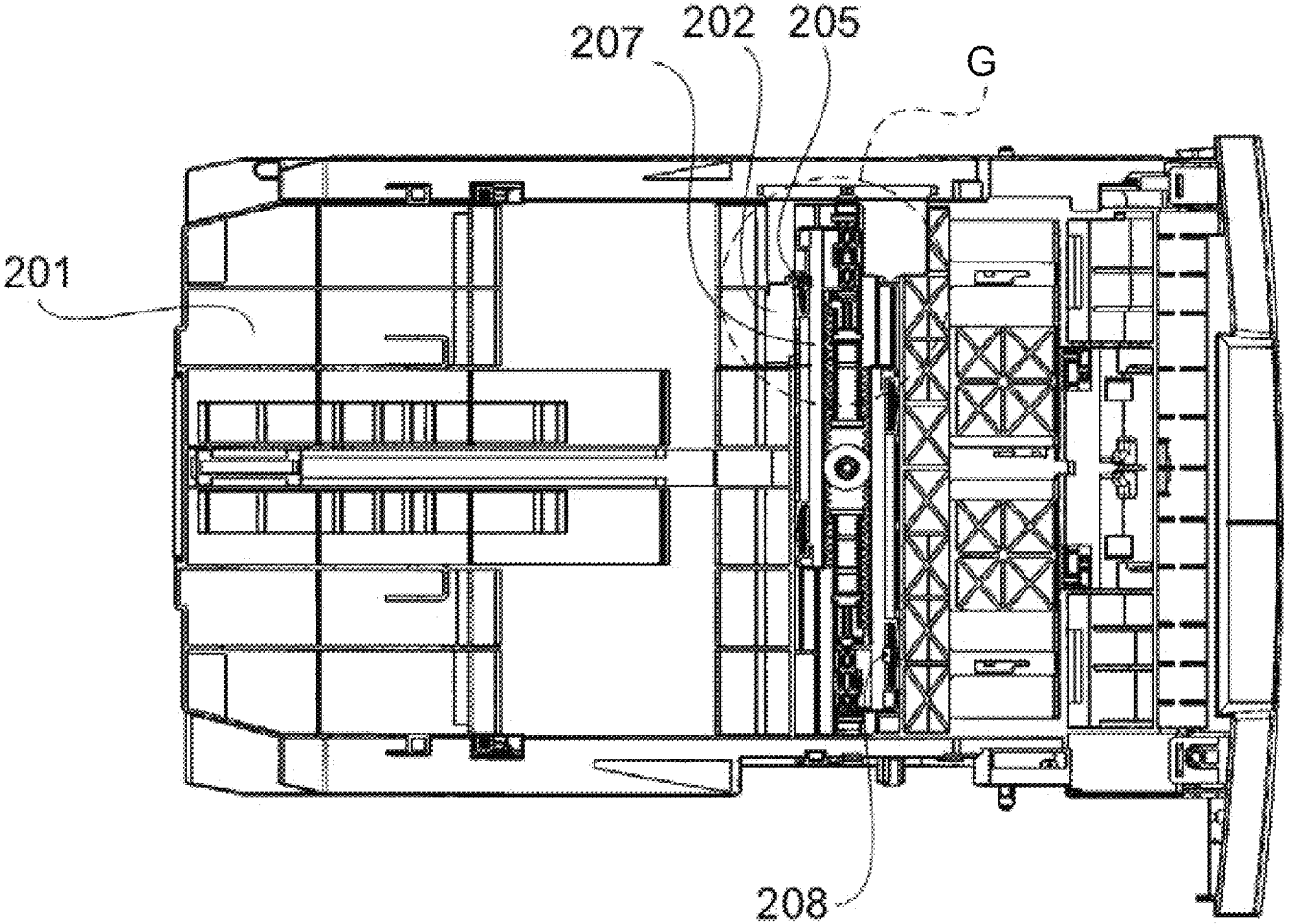
FIG. 20 is a bottom side view showing a sheet supply tray according to a second embodiment of the present invention.
Figure 21:
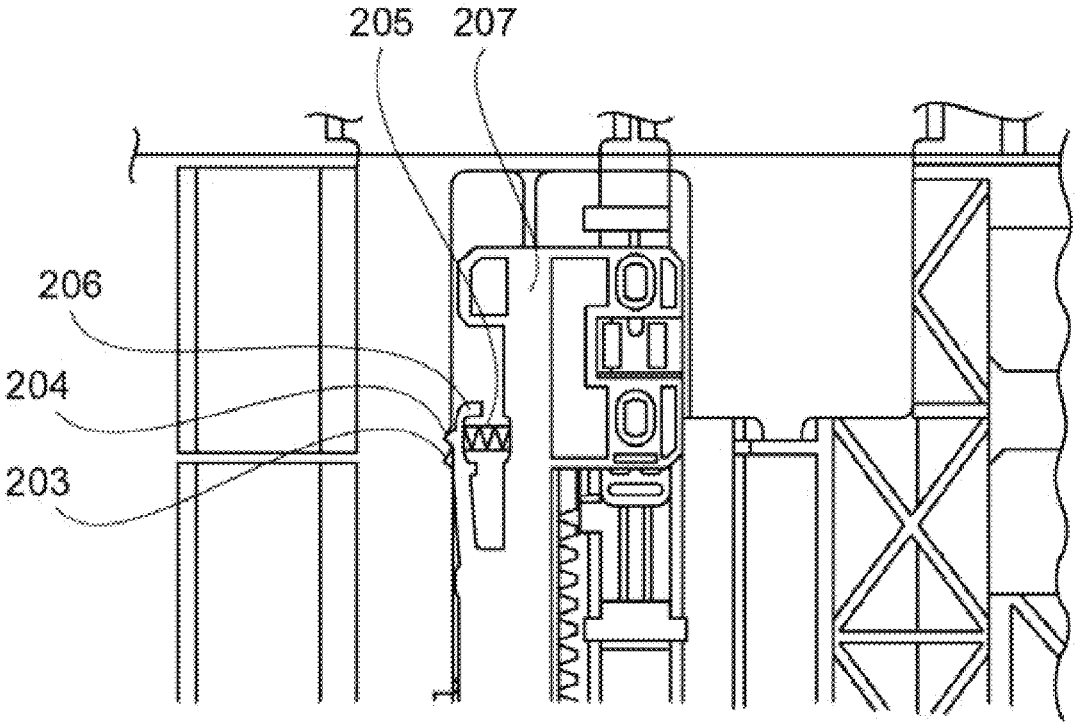
FIG. 21 is a schematic enlarged view of a portion G shown in FIG. 20 showing the sheet supply tray according to the second embodiment of the present invention.

FIG. 20 is a bottom side view showing the sheet supply tray 201 according to the second embodiment of the present invention. FIG. 21 is a schematic enlarged view of a portion G shown in FIG. 20 showing the sheet supply tray 201 according to the second embodiment of the present invention.

As shown in FIGS. 20 and 21, an L-side rack 207 is attached to the L-side sheet guide 104 of the sheet supply tray 201, and includes a cut portion with a U character shape at a position where the L-side rack 207 abuts against the sheet supply tray 201. A guide protrusion 206 is formed at one end portion of the cut portion with the U character shape, and has a triangular shape capable of deforming elastically. A guide spring 205 is disposed inside the cut portion with the U character shape as an urging member with respect to the cut portion for urging the cut portion in a widening direction. A guide groove portion 202 with a triangular shape is formed in the sheet supply tray 201 at a position where the sheet supply tray 201 abuts against the guide protrusion 206. The guide protrusion 206 and the guide groove portion 202 constitute a guide portion.

Figure 22:
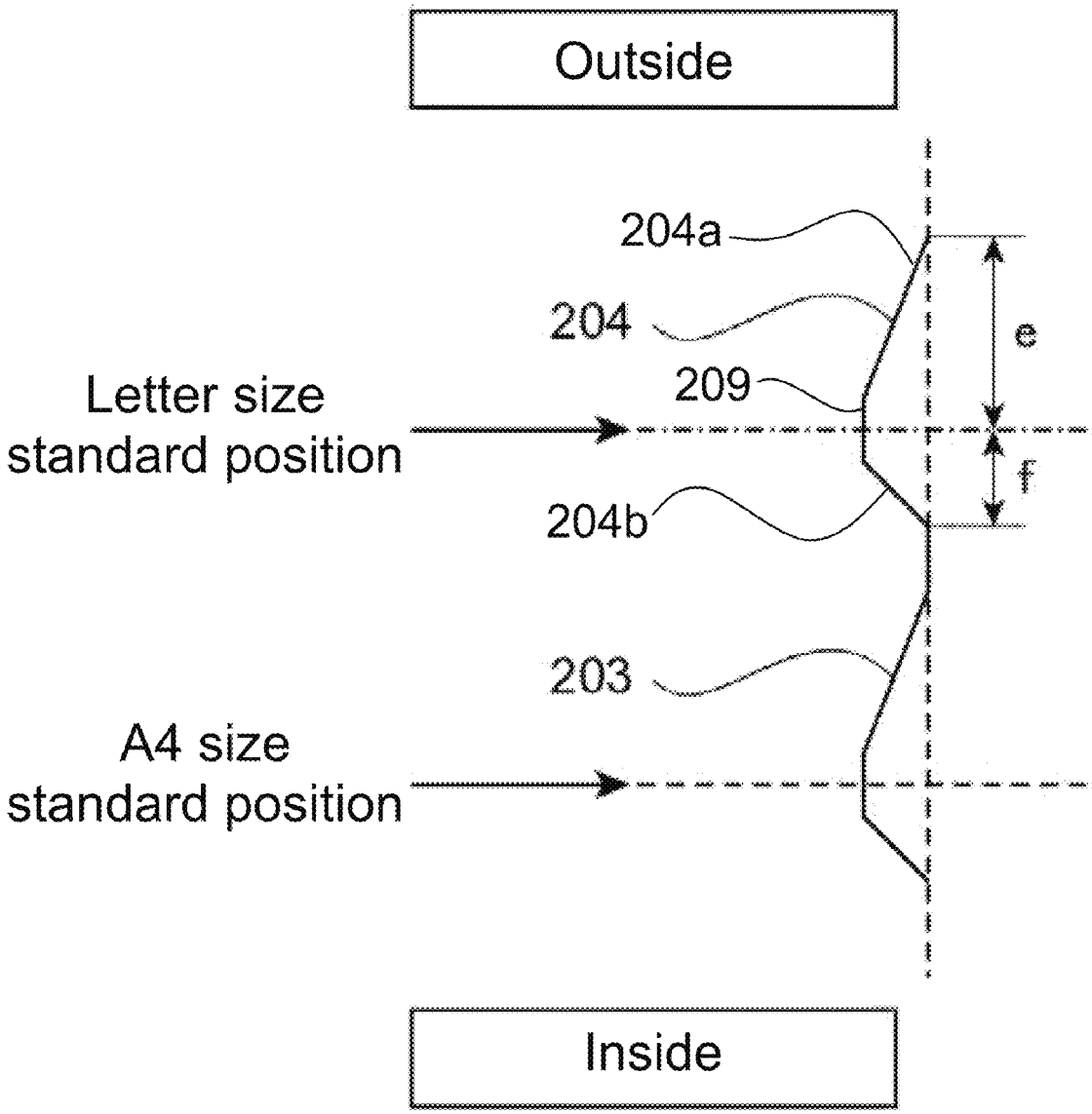
FIG. 22 is a schematic enlarged view showing a guide groove portion of the sheet supply tray according to the second embodiment of the present invention.

FIG. 22 is a schematic enlarged view showing the guide groove portion 202 of the sheet supply tray 201 according to the second embodiment of the present invention. As shown in FIG. 22, the guide groove portion 202 includes a groove as a deepest portion at a position where the distance between the contact surfaces of the L-side sheet guide 104 and the R-side sheet guide 105 becomes equal to the standard size of the sheet P, and the guide protrusion 206 becomes a second shape to engage each groove portion when the L-side sheet guide 104 moves.

In the embodiment, as shown in FIG. 21, the guide groove portion 202 includes an A4-size guide groove 203 and a letter size guide groove 204. In the A4-size guide groove 203 and the letter size guide groove 204, the guide protrusion 206 becomes a first shape as a deformation state from where the guide protrusion 206 is pushed and deformed to a largest extent to the deepest portion.

As shown in FIG. 22, the A4-size guide groove 203 and the letter size guide groove 204 have butting surfaces such that a distance between the guide protrusion 206 and an outer distance e of the abutting surface becomes greater than an inner distance f thereof with a top portion thereof as a center in the width direction of the sheet P.

In the embodiment, the guide groove portion 202 includes a first inclined portion 204*a* and a second inclined portion 204*b*. More specifically, as shown in FIG. 22, the guide groove portion 202 includes the first inclined portion 204*a* inclined up to the letter size guide groove 204 within the outer distance e. Further, the guide groove portion 202 includes the second inclined portion 204*b* inclined up to the letter size guide groove 204 within the inner distance f. The first inclined portion 204*a* has a length greater than that of the second inclined portion 204*b*. In the embodiment, the outer distance e is 1.5 mm (e=1.5 mm), and the inner distance f is 1.0 mm (f=1.0 mm)

An operation of setting the sheet P in the sheet supply tray 201 will be explained next.

When the sheet P is set in the sheet supply tray 201, similar to the first embodiment, the L-side sheet guide 104 and the R-side sheet guide 105 move according to the size of the sheet P. At this moment, in the second embodiment, when the L-side sheet guide 104 approaches the standard size position, the guide protrusion 206 urged with the guide spring 205 enters the guide groove portion 202. Further, the top portion of the triangular shape forming the guide protrusion 206 is urged with the guide spring 205, and is pulled into a direction matching to the top portion of the triangular shape of the guide groove portion 202.

In the embodiment, as described above, it is configured that the outer distance e becomes greater than the inner distance f. Accordingly, with respect to the standard size, the L-side sheet guide 104 is pulled in a wider effective range at a wider position (outer distance) than a narrower position (inner distance).

As described above, in the embodiment, when the L-side sheet guide 104 is set, the L-side sheet guide 104 is pulled to the standard size position at a position near the standard size, thereby making it possible to prevent the L-side sheet guide 104 from being set at a wrong position. Further, when the L-side sheet guide 104 is set and pulled to the standard size position, an operator can sense the pulled feeling, thereby making it possible to notify the operator that the L-side sheet guide 104 is set at the standard size position.

Further, in the embodiment, a force is generated in the direction that the guide protrusion 206 is pulled into the guide groove portion 202. Accordingly, when an impact is applied in a direction that the sheet supply tray 201 is inserted into the expansion sheet supply apparatus 103, it is possible to prevent the distance between the L-side sheet guide 104 and the R-side sheet guide 105 from increasing with respect to the sheet size. Further, the guide spring 205 generates friction. Accordingly, at the irregular size position where the guide groove portion 202 is not formed, it is possible to prevent the distance between the L-side sheet guide 104 and the R-side sheet guide 105 from increasing due to an impact.

Third Embodiment

A third embodiment of the present invention will be explained next. In the third embodiment, the printer 400, a sheet supply tray 301, and the expansion sheet supply apparatus 103 have configurations similar to those in the first and second embodiments. Accordingly, similar components are designated with the same reference numerals, and only differences from the first and second embodiments will be explained.

Figure 23:
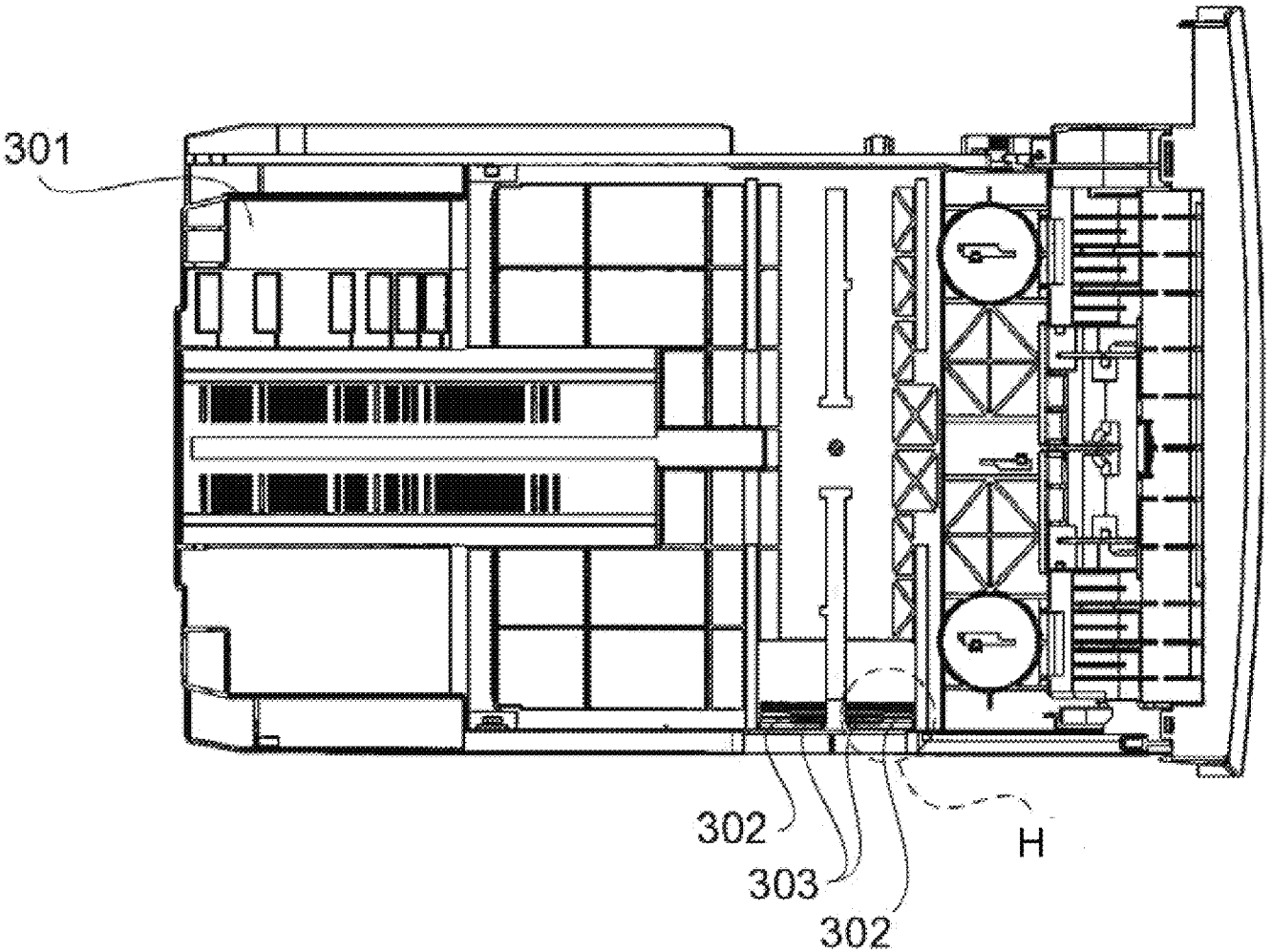
FIG. 23 is a plan view showing a sheet supply tray according to a third embodiment of the present invention.
Figure 24:
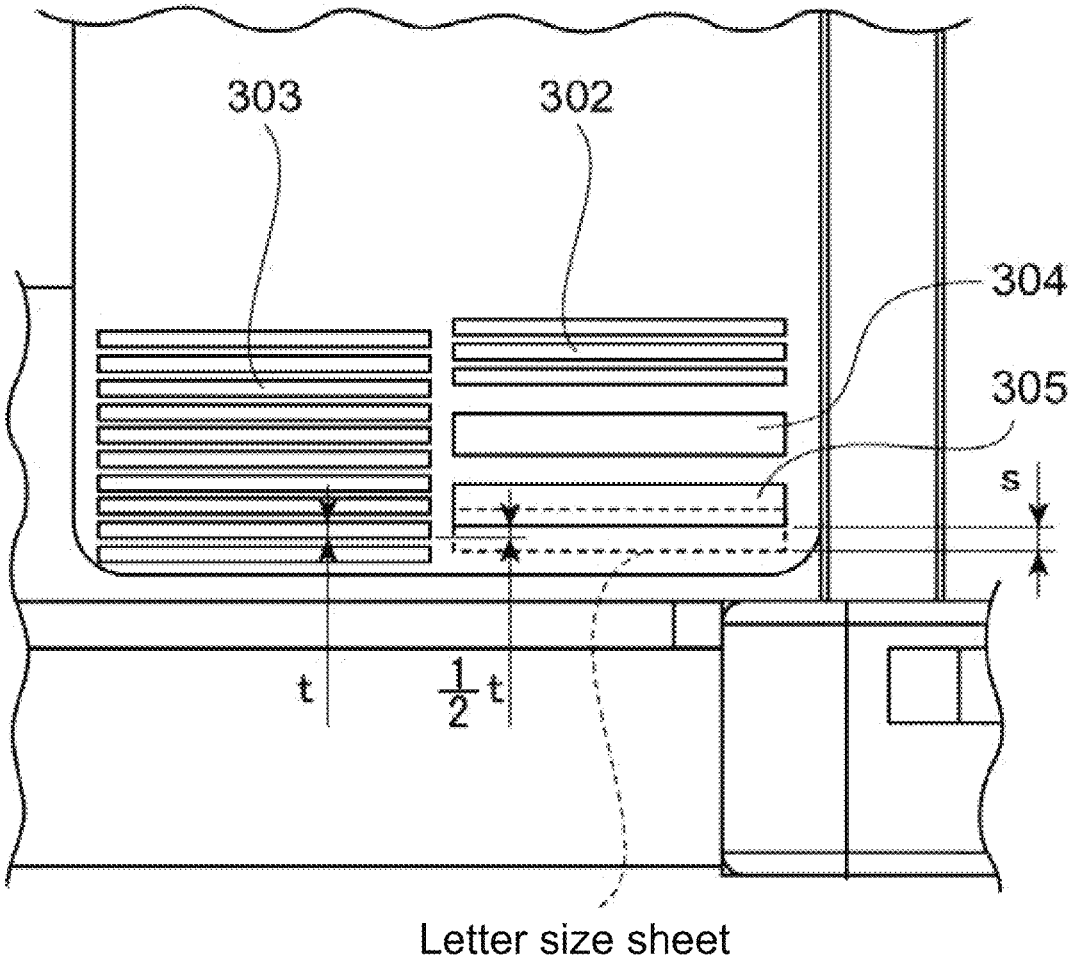
FIG. 24 is a schematic enlarged view of a portion H shown in FIG. 23 showing the sheet supply tray according to the third embodiment of the present invention.

FIG. 23 is a plan view showing the sheet supply tray 301 according to the third embodiment of the present invention. FIG. 24 is a schematic enlarged view of a portion H shown in FIG. 23 showing the sheet supply tray 301 according to the third embodiment of the present invention.

As shown in FIGS. 23 and 24, the sheet supply tray 301 includes a first engaging groove group 302. The first engaging groove group 302 is configured such that the distance between the contact surfaces of the L-side sheet guide 104 and the R-side sheet guide 105 contacting with the edges of the sheet P becomes slightly smaller than the standard size by a distance 2s. In other words, the L-side sheet guide 104 and the R-side sheet guide 105 engage at a distance smaller than a size that an operator intends by the distance 2s. In the embodiment, the distance s is 1 mm (s=1 mm), and may be adjusted according to an accuracy of the sheet.

In the embodiment, the first engaging groove group 302 includes an A4-size sheet groove 304 for setting the A4-size sheet and a letter size sheet groove 305 for setting the letter size sheet. Further, a second engaging groove group 303 is disposed away from the letter size sheet groove 305 by a distance ½ t. In the embodiment, the distance ½ t is 1 mm.

An operation of setting the sheet P in the sheet supply tray 301 will be explained next. In the embodiment, it is assumed that the sheet P has the A4-size with the width of 209 mm, slightly smaller than the standard width of 210 mm.

When the sheet P is set in the sheet supply tray 301, the L-side sheet guide 104 moves to a position where the first engaging claws 123 engages the A4-size sheet groove 304. At this moment, the L-side rack 107 fixed to the L-side sheet guide 104 is connected to the R-side rack 108 fixed to the R-side sheet guide 105 through the pinion gear 109. Accordingly, when the L-side sheet guide 104 moves, the R-side sheet guide 105 moves together with the L-side sheet guide 104, so that the contact surfaces thereof contacting with the edges of the sheet P becomes 208 mm.

In this state, when the sheet P with the width of 209 mm is set in the sheet supply tray 301, the L-side sheet guide 104 and the R-side sheet guide 105 are pushed sideway in the width direction of the sheet P due to rigidity of the sheet P. When the sheet supply tray 301 is inserted into the expansion sheet supply apparatus 103 in this state, similar to the first embodiment, the L-side sheet guide 104 is disengaged, so that the L-side sheet guide 104 and the R-side sheet guide 105 automatically move to the positions corresponding to the width of the sheet P, and then engage once again.

In the embodiment, the sheet P has the width of 209 mm. Accordingly, the second engaging claws 124 engages one of engaging grooves of the second engaging groove group 303 outside the A4-size sheet groove 304. At this moment, the distance between the L-side sheet guide 104 and the R-side sheet guide 105 becomes 209 mm.

As described above, in the third embodiment, the distance between the contact surfaces of the L-side sheet guide 104 and the R-side sheet guide 105 contacting with the edges of the sheet P becomes slightly smaller than the standard size by the distance 2s. Accordingly, even when the sheet P has a size smaller than that standard side due to a dryness or a cutting variance of the sheet P, it is possible to set the sheet P without creating a gap between the L-side sheet guide 104 and the sheet P simply through setting the L-side sheet guide 104 at the standard size.

In the embodiments described above, the color printer of the electro-photography type is explained as an example, and the present invention is not limited thereto. The present invention is applicable to a sheet supply apparatus and an image forming apparatus such as a facsimile, a copier, and a multi-function product, in which a sheet supply tray is provided with a sheet guide.

The disclosure of Japanese Patent Application No. 2008-217028, filed on Aug. 26, 2008, is incorporated in the application by reference.

While the invention has been explained with reference to the specific embodiments of the invention, the explanation is illustrative and the invention is limited only by the appended claims.

What is claimed is:

1. A sheet supply apparatus, comprising:

a print medium storage device for storing a print medium, said print medium storage device including, a guide member for guiding the print medium thus stored;

an engaging portion for engaging the guide member at a specific position;

an engaged portion for engaging the engaging portion; and an operation portion disposed to be movable for separating the engaging portion from the engaged portion; and an abutting portion for abutting against the operation portion to move the operation portion so that the engaged portion is disengaged from the engaging portion when the print medium storage device is inserted into the sheet supply apparatus and situated at a first position, and for separating from the operation portion so that the engaged portion engages the engaging portion when the print medium storage device is situated at a second position after the print medium storage device is inserted into the sheet supply apparatus, wherein said engaging portion includes an engaging claw, and said engaged portion includes an engaging groove group, and said engaging claw and said engaging groove group are arranged in at least n stages, said engaging groove group in an n-th stage being arranged away from the engaging groove group in a first stage by a distance equal to 1/n of a minimum itch of the engaging groove group in the first stage.

2. A sheet supply apparatus comprising:

a print medium storage device for storing a print medium, said print medium storage device including, a guide member for guiding the print medium thus stored;

an engaging portion for engaging the guide member at a specific position;

an engaged portion for engaging the engaging portion; and an operation portion disposed to be movable for separating the engaging portion from the engaged portion; and an abutting portion for abutting against the operation portion to move the operation portion when the print medium storage device is situated at a first position, and for separating from the operation portion when the print medium storage device is situated at a second position, wherein said engaging portion includes an engaging claw, said engaged portion includes an engaging groove group, and said engaging claw and said engaging groove group are arranged in at least two stages, said stages being arranged at arrangement positions so that the arrangement positions are not aligned on a same straight line in an arrangement direction thereof.

3. The sheet supply apparatus according to claim 2, wherein said engaging groove group is arranged so that the guide member is disposed at a position corresponding to a standard size of the print medium.

4. The sheet supply apparatus according to claim 3, further comprising a guide portion for guiding the engaging claw to the engaging groove group so that the guide member is disposed at the position corresponding to the standard size of the print medium.

5. The sheet supply apparatus according to claim 4, wherein said guide portion includes a guide protrusion formed on the guide member and a guide groove portion for guiding the protruding portion.

6. The image forming apparatus according to claim 5, wherein said guide groove portion includes a slide portion for maintaining the guide protrusion in a first shape;

a deepest portion for maintaining the guide protrusion in a second shape;

a first inclined portion inclined from the slide portion to the deepest portion; and a second inclined portion inclined from the slide portion to the deepest portion, said first inclined portion being inclined at an inclined angle smaller than that of the second inclined portion.

7. The image forming apparatus according to claim 6, wherein said first inclined portion is situated outside the second inclined portion with the deepest portion in between.

8. The sheet supply apparatus according to claim 6, wherein said deepest portion is arranged at a position where the engaging claw engages the engaging groove group disposed at the position corresponding to the standard size of the print medium.

9. The image forming apparatus according to claim 5, further comprising an urging member for urging the guide protrusion toward the guide groove portion.

10. The image forming apparatus according to claim 9, wherein said urging member includes a spring.

11. An image forming apparatus, comprising:

a sheet supply apparatus having a print medium storage device for storing a print medium, said print medium storage device including, a guide member for guiding the print medium thus stored;

an engaging portion for engaging the guide member at a specific position;

an engaged portion for engaging the engaging portion; and an operation portion disposed to be movable for separating the engaging portion from the engaged portion; and an abutting portion for abutting against the operation portion to move the operation portion when the print medium storage device is situated at a first position, and for separating from the operation portion when the print medium storage device is situated at a second position, wherein said engaging portion includes an engaging claw, and said engaged portion includes an engaging groove group, said engaging claw and said engaging groove group being arranged in at least two stages, said stages being arranged at arrangement positions so that the arrangement positions are not aligned on a same straight line in an arrangement direction thereof.

12. The sheet supply apparatus according to claim 11, wherein said engaging groove group in at least one of the two stages is arranged so that the guide member is disposed at a position corresponding to a standard size of the print medium, said sheet supply apparatus further comprising a guide portion for guiding the engaging claw to the engaging groove group in the at least one of the two stages arranged so that the guide member is disposed at the position corresponding to the standard size of the print medium, said guide portion including a guide protrusion formed on the guide member and a guide groove portion for guiding the protruding portion.

13. The image forming apparatus according to claim 12, wherein said guide groove portion includes a slide portion for maintaining the guide protrusion in a first shape;

a deepest portion for maintaining the guide protrusion in a second shape;

a first inclined portion inclined from the slide portion to the deepest portion; and a second inclined portion inclined from the slide portion to the deepest portion, said first inclined portion being inclined at an inclined angle smaller than that of the second inclined portion, said first inclined portion being situated outside the second inclined portion with the deepest portion in between.

14. The image forming apparatus according to claim 13, wherein said deepest portion is arranged at a position where the engaging claw engages the engaging groove group disposed at the position corresponding to the standard size of the print medium.

15. The image forming apparatus according to claim 11, wherein said engaging groove group of at least one of the two stages is arranged so that the guide member is disposed at a position narrower than the standard size of the print medium.

16. The sheet supply apparatus according to claim 11, wherein said print medium storage device is arranged to be at the first position in a middle of inserting the print medium storage device into an image forming apparatus, and said print medium storage device is arranged to be at the second position when the print medium storage device is completely inserted into the image forming apparatus, or is completely detached from the image forming apparatus.

* * * * *